US006039027A

United States Patent [19]

Sato et al.

[11] Patent Number: 6,039,027

[45] Date of Patent: Mar. 21, 2000

[54] THROTTLE VALVE DEVICE

[75] Inventors: Hisaaki Sato, Gunma; Masato Kumagai, Saitama; Tomoaki Araki, Gunma, all of Japan

[73] Assignee: Unisia Jecs Corporation, Atsugi, Japan

[21] Appl. No.: 09/200,979

[22] Filed: Nov. 30, 1998

[30] Foreign Application Priority Data

Dec. 4, 1997 [JP] Japan ..... 9-350004
Dec. 4, 1997 [JP] Japan ..... 9-350005

[51] Int. Cl.[7] ..... F02D 11/10
[52] U.S. Cl. ..... 123/399
[58] Field of Search ..... 123/361, 399, 123/400

[56] References Cited

U.S. PATENT DOCUMENTS

| | | | |
|---|---|---|---|
| 4,500,478 | 2/1985 | Furukawa et al. | 123/361 X |
| 4,586,471 | 5/1986 | Horada et al. | 123/399 |
| 4,947,815 | 8/1990 | Peter | 123/399 |
| 5,161,504 | 11/1992 | Guest, Jr. et al. | 123/399 X |
| 5,490,487 | 2/1996 | Kato et al. | 123/399 |

FOREIGN PATENT DOCUMENTS

| | | |
|---|---|---|
| 2-500677 | 3/1990 | Japan . |
| 4-203219 | 7/1992 | Japan . |

*Primary Examiner*—Tony M. Argenbright

*Attorney, Agent, or Firm*—Foley & Lardner

[57] ABSTRACT

A throttle valve device for an internal combustion engine of an automotive vehicle. The throttle valve device comprises a throttle body having a part of an intake air passageway. A throttle valve is fixedly mounted on a valve shaft and rotatably disposed in the part of the intake air passageway. A driving device is disposed to the throttle body to drive the throttle valve through the valve shaft. A reduction gear mechanism through which the driving device and the valve shaft are mechanically connected is provided to transmit a driving force of the driving device to the valve shaft in a manner to accomplish a speed-reduction for a rotational movement of the driving device to be transmitted to the valve shaft. A cam follower is rotatably disposed to the throttle body. A single biasing device is provided to always bias the cam follower onto the cam surface of the cam lever. Additionally, a cam lever is incorporated with a gear of the reduction gear mechanism to rotate together with the gear as a one-piece member. The cam lever has an opening whose periphery serves as a cam surface on which the cam follower is in press contact under a biasing force of the biasing device. The cam surface is configured to allow the throttle valve to rotate from a fully closed position to a fully opened position. The cam surface has a bent section which causes the throttle valve to take a partly opened position when the driving force of the driving device is released. The partly opened position is between the fully closed and fully opened positions.

11 Claims, 19 Drawing Sheets

THROTTLE VALVE DEVICE

BACKGROUND OF THE INVENTION

1. Field of the Invention

This invention relates to improvements in a throttle valve device for variably controlling an amount of intake air to be supplied to an engine of an automotive vehicle or the like in accordance with an amount of operation of an accelerator, and more particularly to the improvements in the throttle valve device of the type wherein a throttle valve is rotated to open and close by using an actuator such as an electric motor.

2. Description of the Prior Art

Hitherto a variety of throttle valve devices for an internal combustion engine have been proposed and put into practical use. An example of such throttle valve devices is arranged to be disposed in an intake air passageway leading to cylinders of the engine and include a throttle body in which a part of the intake air passageway is formed. A throttle valve is rotatably disposed through a valve shaft in the throttle body and adapted to open and close the part of the intake air passageway in accordance with a rotational movement of the valve shaft. An electric motor is provided in the throttle body to drive the valve shaft. Additionally, a reduction gear mechanism is provided between the electric motor and the valve shaft to transmit a driving force of the electric motor to the valve shaft upon making a rotational speed reduction. Such a throttle valve device is disclosed in Japanese Patent Publication (Kohyo) No. 2-500677 and Japanese Patent Publication No. 4-203219.

However, drawbacks have been encountered in the above-discussed conventional throttle valve device, as set forth below. The conventional throttle valve device is provided with first biasing means for always biasing the throttle valve in a direction toward a fully closed position, and second biasing means for biasing the throttle valve in the opposite direction to that by the first biasing means so as to bias the throttle valve in a direction toward an intermediately or partly opened position between the fully closed position and a fully opened position.

In order to open the throttle valve by the electric motor, the rotational force of the electric motor is transmitted through the reduction gear mechanism to the valve shaft of the throttle valve so as to rotate the valve shaft against the bias of the first biasing means. The throttle valve changes the amount of intake air to be supplied to the engine, in accordance with the opening degree of the throttle valve, thereby variably altering a rotational power output of the engine. Additionally, for example, in case that the engine is stopped (supplying no power to the electric motor) or that the electric motor is in trouble, when the throttle valve is rotated toward the fully closed position over the intermediately opened position under the action of the first biasing means, the rotation force in the opposite direction to that by the first biasing means is applied to throttle valve by the second biasing means, thus keeping the throttle valve at the intermediately opened position against the bias of the first biasing means.

Thus, the above conventional throttle valve device is configured such that the throttle valve is always biased toward the closing position by the first biasing means while is biased toward the intermediately opened position by the second biasing means. These first and second biasing means are constituted respectively of two springs, and therefore the number of parts is increased thereby lowering operational efficiency during assembly of the throttle valve device.

Additionally, since the two springs are provided within the throttle body, restriction in layout arises thereby making it possible to small-size and compact the whole throttle valve device. Furthermore, a load torque (the biasing force of the first and second biasing means) to be applied to the electric motor is changed between a case where throttle valve is driven in an opening direction over the intermediately opened position and a case where the throttle valve is driven in a closing direction over the intermediately opened position. Therefore, an opening degree control or adjustment of the throttle valve under the action of the electric motor unavoidably becomes ununiform.

BRIEF SUMMARY OF THE INVENTION

It is an object of the present invention to provide an improved throttle valve device, which can effectively overcome drawbacks encountered in conventional throttle valve devices of the similar types.

Another object of the present invention is to provide an improved throttle valve device which is improved in operational efficiency during assembly and small-sized to be compacted, while stabilizing the opening degree control of the throttle valve.

A further object of the present invention is to provide an improved throttle valve device in which a throttle valve can be biased to an intermediately opened or partly opened position by only single biasing device (such as a single spring), thereby reducing the number of component parts of the throttle valve device.

An aspect of the present invention resides in a throttle valve device which comprises a throttle body having a part of an intake air passageway. A throttle valve is fixedly mounted on a valve shaft and rotatably disposed in the part of the intake air passageway. A driving device is disposed to the throttle body to drive the throttle valve through the valve shaft. A reduction gear mechanism through which the driving device and the valve shaft are mechanically connected is provided to transmit a driving force of the driving device to the valve shaft in a manner to accomplish a speed-reduction for a rotational movement of the driving device to be transmitted to the valve shaft. A cam lever is incorporated with the reduction gear mechanism and having a cam surface which is configured to allow the throttle valve to rotate from a fully closed position to a fully opened position. The cam surface has a bent section which causes the throttle valve to take a partly opened position located between the fully closed and opened positions. A cam follower is rotatably disposed to the throttle body and in contact with the cam surface of the cam lever. Additionally, a biasing device is provided to always bias the cam follower onto the cam surface of the cam lever. The biasing device is able to force the cam follower onto the bent section of the cam surface so as to keep the throttle valve at the partly opened position when the driving force of the driving device is released.

Another aspect of the present invention resides in a throttle valve device which comprises a throttle body having a part of an intake air passageway. A throttle valve is fixedly mounted on a valve shaft and rotatably disposed in the part of the intake air passageway. A driving device is disposed to the throttle body to drive the throttle valve through the valve shaft. A reduction gear mechanism through which the driving device and the valve shaft are mechanically connected is provided to transmit a driving force of the driving device to the valve shaft in a manner to accomplish a speed-reduction for a rotational movement of the driving device to be transmitted to the valve shaft. A cam follower is rotatably disposed to the throttle body. A single biasing device is provided to always bias the cam follower onto the cam surface of the cam lever. Additionally, a cam lever is incorporated with a gear of the reduction gear mechanism to rotate together with the gear as a one-piece member. The cam lever has an opening whose periphery serves as a cam surface on which the cam follower is in press contact under a biasing force of the biasing device. The cam surface is configured to allow the throttle valve to rotate from a fully closed position to a fully opened position. The cam surface has a bent section which causes the throttle valve to take a partly opened position when the driving force of the driving device is released. The partly opened position is between the fully closed and fully opened positions.

With the above arrangement, the driving force of the driving device is transmitted through the reduction gear mechanism to both the valve shaft of the throttle valve and the cam lever, so that the cam lever makes its rotational movement between the fully closed position and the fully opened position of the throttle valve. At this time, the cam follower follows the movement of the cam lever against the biasing force of the biasing device, in which the cam follower makes its rotation along the cam surface of the cam lever while providing a reaction of the biasing force of the biasing device to the cam lever which is rotating. Accordingly, when the driving force of the driving device is released, the cam follower is biased toward the bent section of the cam surface of the cam lever under the biasing force of the biasing device, so that the cam lever is rotationally moved through the cam follower. This stops the rotational movement of the cam lever at the position where the cam follower comes into contact with the bent section, and can keep the throttle valve at the intermediately opened position corresponding to the above bent section of the cam lever. As a result, the throttle valve can be biased to take the intermediately opened position by using only the single biasing device, thereby reducing the number of component parts of the throttle valve device.

Besides, since the cam lever is provided incorporated with the reduction gear mechanism, the throttle valve device can be small-sized and compacted. Furthermore, since the throttle valve is biased to take the partly opened position, a load torque and the like acting as a reaction onto the driving device can be prevented from becoming ununiform between a case where the throttle valve is driven in the opening direction and a case where the throttle valve is driven in the closing direction, thus stabilizing the opening degree control for the throttle valve under the action of the driving device.

BRIEF DESCRIPTION OF THE DRAWINGS

In the drawings, like reference numerals designate like parts and elements throughout all the figures in which:

FIG. 2 is an enlarged front view taken in the direction of arrows substantially along the line 2—2 of FIG. 1, in a condition where a cover for a gear casing has been removed for the purpose of clearly disclosing a reduction gear mechanism and the like;

FIG. 19 is an enlarged front view taken in the direction of arrows substantially along the line 19—19 of FIG. 18, in a condition where a cover for a gear casing has been removed for the purpose of clearly disclosing a reduction gear mechanism and the like;

DETAILED DESCRIPTION OF THE INVENTION

Figure 1:
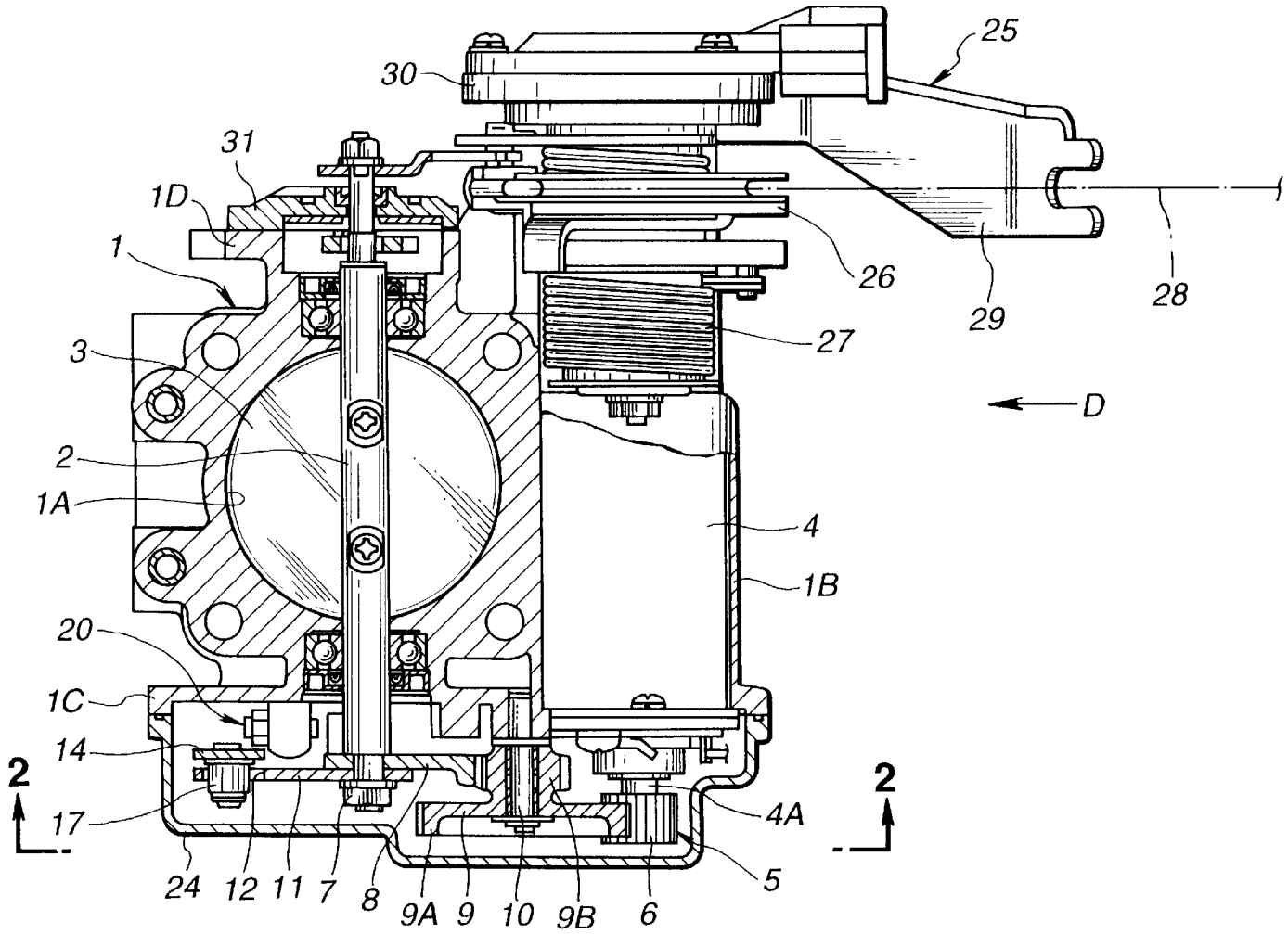
FIG. 1 is a vertical sectional view of a first embodiment of a throttle valve device according to the present invention.

Referring now to FIGS. 1 to 12, a first embodiment of a throttle valve device is illustrated by the reference character D. The throttle valve device D of this embodiment is for a gasoline-fueled internal combustion engine (not shown) of an automotive vehicle. The throttle valve device D comprises a throttle body 1 which serves as an outer shell of the throttle valve device D and is formed by using aluminum die-casting or the like. The throttle body 1 is formed thereinside with a generally cylindrical throttle chamber 1A which serves as a part of an intake air passageway communicated with the inside of each cylinder (not shown) of the engine.

A motor storing casing 1B is formed integral with a main section (not identified) of the throttle body 1 defining the throttle chamber 1A so as to form a part of the throttle body 1, in which the motor storing casing 1B is separate a certain distance from the throttle chamber 1A. Additionally, a gear casing 1C is formed integral with the main section of the throttle body 1 and located at the side of an end section of a throttle shaft 2 which will be discussed after. Further, a sensor casing 1D is formed integral with the main section of the throttle body 1 and located at the side of the other end section of the throttle shaft 2.

The throttle shaft 2 is disposed rotatable through bearings or the like in the throttle body 1. The throttle shaft 2 is formed of a high strength metal rod or the like and extends diametrically through the throttle chamber 1A of the throttle body 1. The one end section of the throttle shaft 2 projects into the gear casing 1C while the other end section projects through the sensor casing 1D.

A throttle valve or disc 3 is fixedly or integrally mounted on an axially central section of the throttle shaft 2 so as to be driven to open or close under the action of the throttle shaft 2. The throttle valve 3 is rotatably disposed in the throttle chamber 1A of the throttle body 1 and constituted of a disc-shaped valve plate. The throttle valve 3 has a diameter generally corresponding to the inner diameter of the throttle chamber 1A. The throttle valve 3 is rotatable around the axis of the valve shaft 2 so as to take a fully closed position indicated in phantom in FIG. 6 and a fully opened position in FIG. 7. In other words, the throttle valve 3 is rotatable between the fully closed position and the fully opened position, thereby variably controlling the amount of intake air to be supplied to the engine in accordance with the opening degree of the throttle valve 3.

An electric motor 4 is encased in the motor storing casing 1B so as to serve as a driving device, and is, for example, a D.C. motor. The electric motor 4 has an output shaft 4A which projects to the side of the gear casing 1C. The output shaft 4A is driven to rotate under power supply to the electric motor 4 from the outside so as to cause the valve shaft 2 to rotate in directions indicated by arrows A, B in FIG. 2 through a reduction gear mechanism 5 which will be discussed after, thus opening and closing the throttle valve 3.

Figure 2:
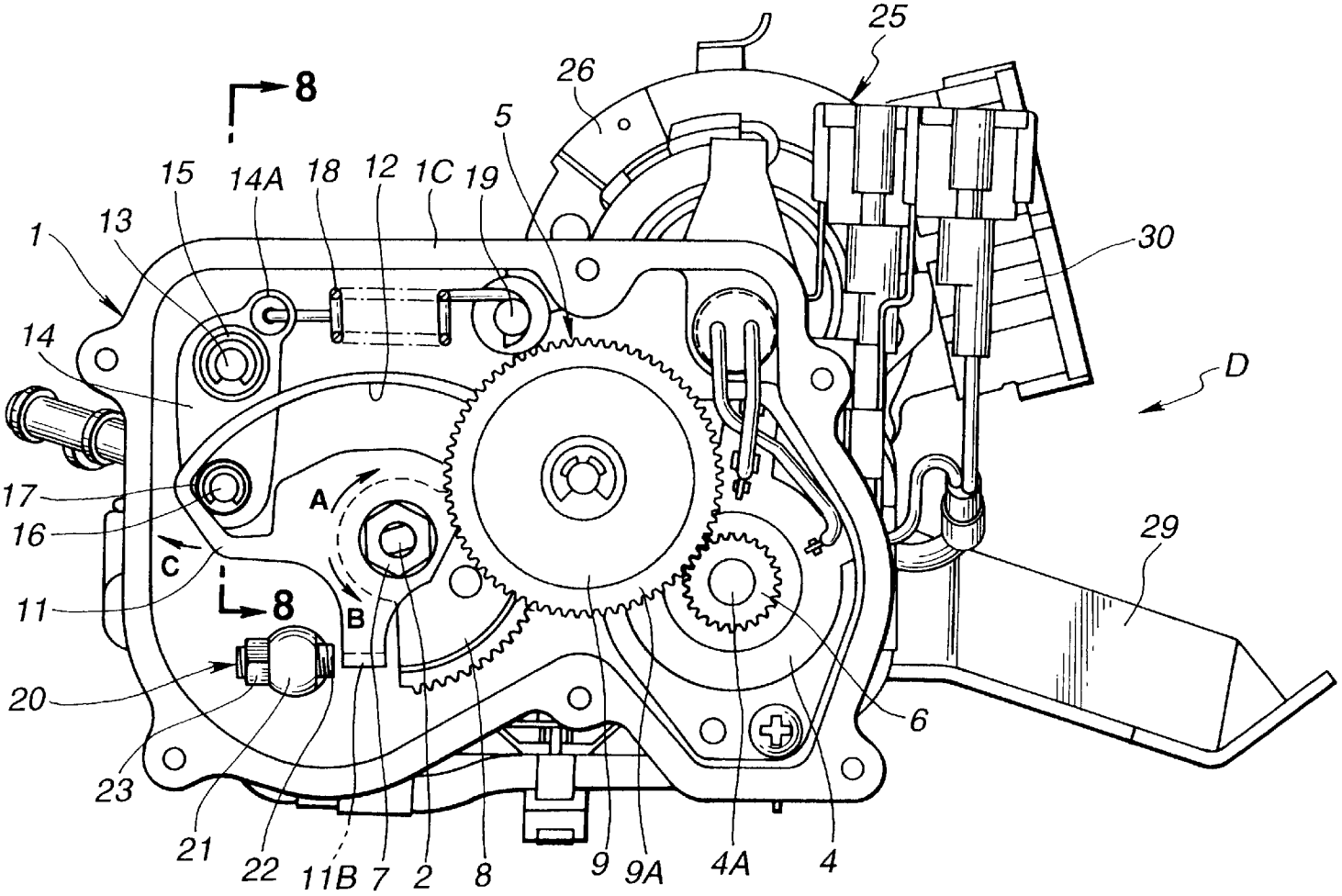
Figure 3:
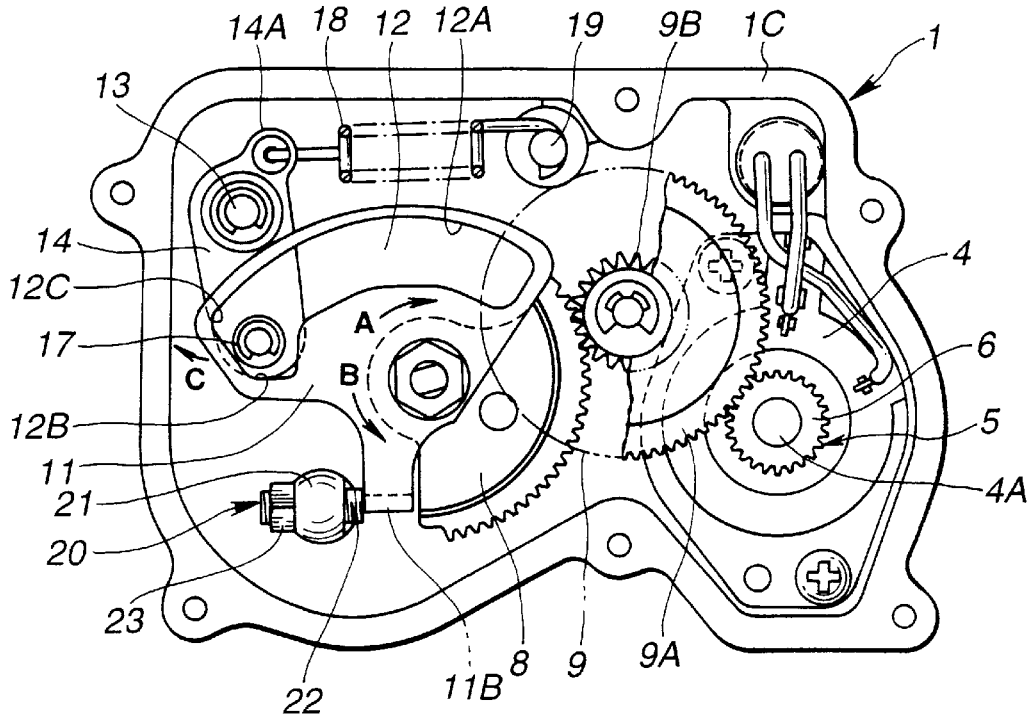
FIG. 3 is an enlarged front view similar to FIG. 2 but showing a state where a throttle valve is rotated to its closed position.
Figure 4:
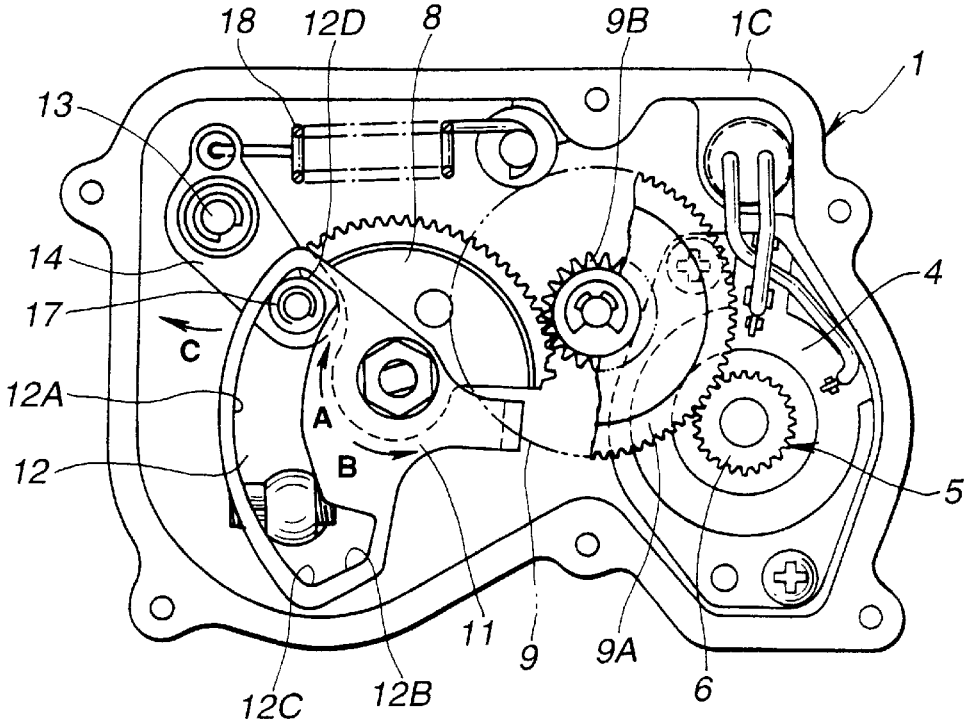
FIG. 4 is an enlarged front view similar to FIG. 2 but showing another state where the throttle valve is rotated to its fully opened position.

The reduction gear mechanism 5 is located inside the gear casing 1C and disposed between the output shaft 4A of the electric motor 4 and the throttle shaft 2. As shown in FIGS. 2 to 4, the reduction gear mechanism 5 includes a small-diameter drive gear 6 fixedly mounted on the output shaft 4A of the electric motor 4. A driven gear 8 is fixedly mounted at the one end section of the valve shaft 2, together with a cam lever 11 which will be discussed after, under the action of a nut 7. An intermediate gear 9 is disposed between the drive gear 6 and the driven gear 8, as will be discussed after. The reduction gear mechanism 5 functions to make a speed-reduction of rotation of the output shaft 4A of the electric motor 4 under the combination of the drive gear 6 and the intermediate gear 9, and another speed-reduction under the combination of the intermediate gear 9 and the driven gear 8, so that a greater rotational force is transmitted to the valve shaft 2 of the throttle valve 3.

Figure 11:
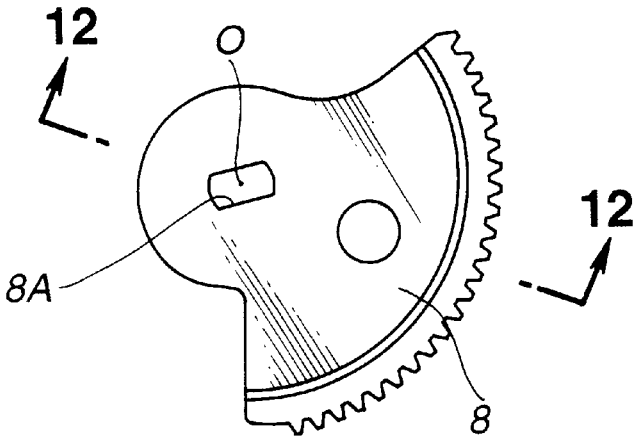
FIG. 11 is an enlarged front view of a driven gear used in the throttle valve device of FIG. 1.
Figure 12:
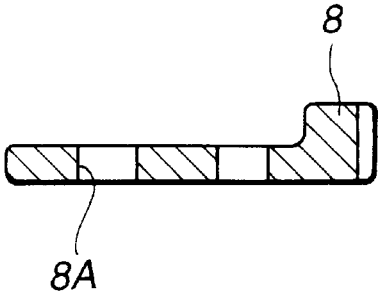
FIG. 12 is a sectional view taken in the direction of arrows substantially along the line 12—12 of FIG. 11.
Figure 13:
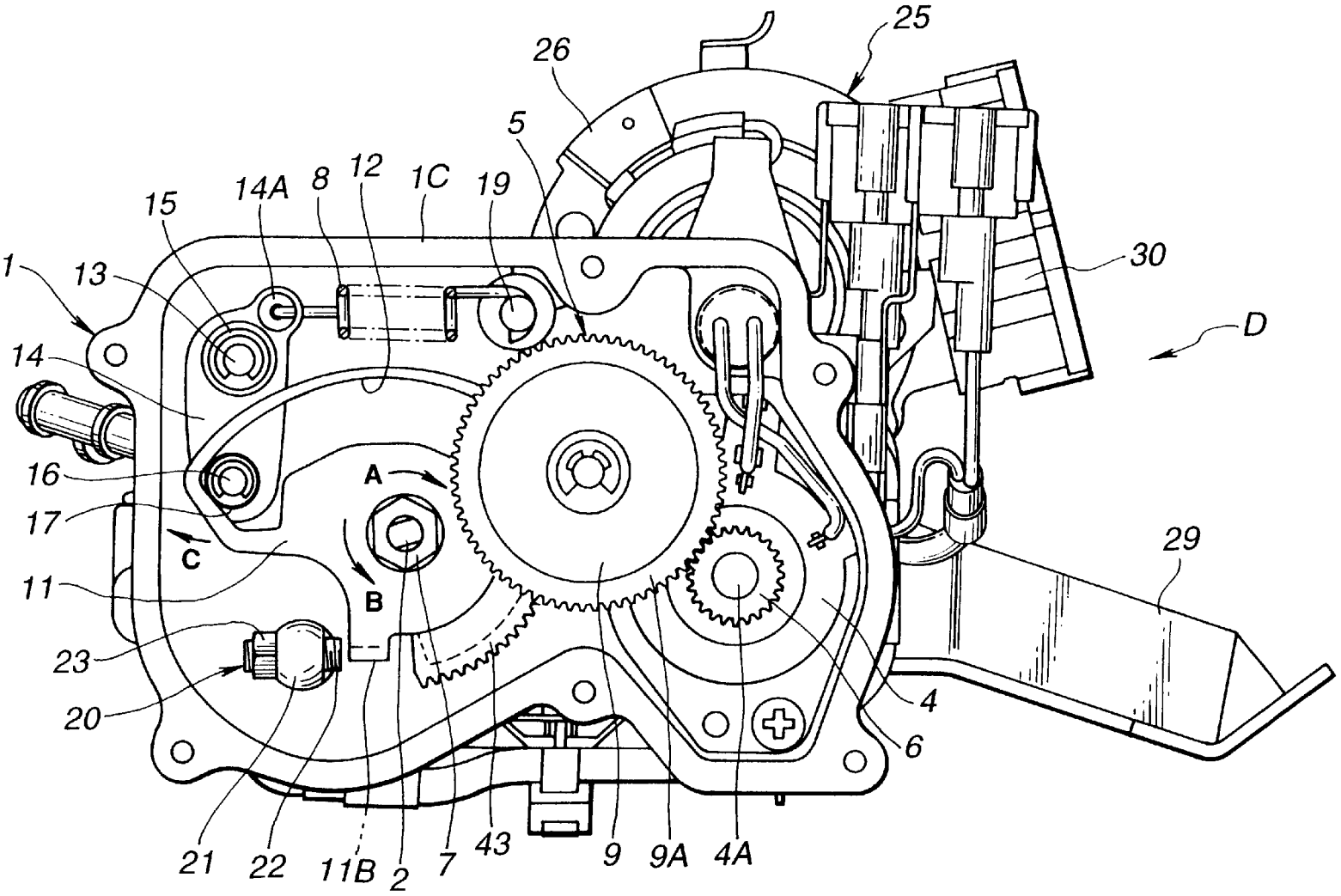
FIG. 13 is an enlarged front view similar to FIG. 2 but showing a second embodiment of the throttle valve device according to the present invention.

As shown in FIGS. 11 and 12, the driven gear 8 is generally sectoral in plan and serves as a sector gear whose diametrical dimension is larger than the diameter of a small-diameter gear section 9B which will be discussed after. A non-circular fitting hole 8A is formed at a section (of the driven gear 8) through which a rotational center axis O passes. The driven gear 8 is fitted on the one end section of the valve shaft 2 in such a manner as to be prevented from rotating relative to the valve shaft 2. Additionally, the driven gear 8 is tightened on the valve shaft 2 by the nut 7 as shown in FIG. 1, so that the driven gear 8 can rotate together with the valve shaft 2 like a one-piece member.

The intermediate gear 9 forming part of the reduction gear mechanism 5 is disposed between the drive gear 6 and the driven gear 8 and is rotatably attached through a support shaft 10 to the gear casing 1C of the throttle body 1 as shown in FIG. 1. The intermediate gear 9 includes a large-diameter gear section 9A and the small-diameter gear section 9B which are integral with each other. The large-diameter gear section 9A is in engagement with the drive gear 6 to have a certain speed reduction ratio as shown in FIG. 2. The small-diameter gear section 9B of the intermediate gear 9 is in engagement with the driven gear 8 to have a certain speed reduction ratio thereby providing a larger rotational torque to the driven gear 8, as shown in FIGS. 3 and 4.

Figure 9:
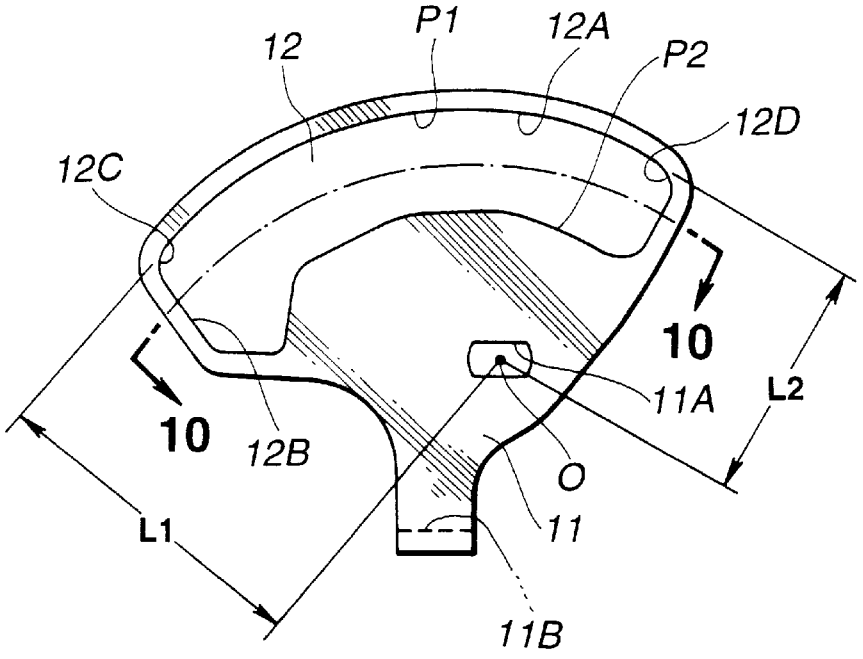
FIG. 9 is an enlarged front view of a cam lever used in the throttle valve device of FIG. 1.
Figure 10:
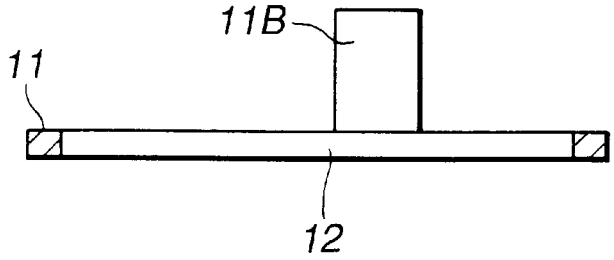
FIG. 10 is a sectional view taken in the direction of arrows substantially along the line 10—10 of FIG. 9.

The cam lever 11 is fixedly mounted together with the driven gear 8 on the one end section of the valve shaft 2. As shown in FIGS. 9 and 10, the cam lever 11 is formed generally sector-shaped by pressing a high strength metal sheet or plate, in which a non-circular fitting hole 11A is formed at a section through which the rotational center axis O of the cam lever 11 passes similarly to in the driven gear 8. The cam lever 11 is fitted together with the driven gear 8 on the one end section of the valve shaft 2 in such a manner as to be prevented from rotating relative to the valve shaft 2. Additionally, the cam lever 11 is tightened on the valve shaft 2 under the action of the nut 7 as shown in FIG. 1. The cam lever 11 is formed with an elongate opening 12 which is formed generally radially separate from the fitting hole 11A, in which the inner periphery of the elongate opening 12 constitutes a cam surface. A roller 17 which will be discussed after is rotatably disposed inside the elongate opening 12 in such a manner that the roller 17 relatively moves on the cam surface along the inner periphery defining the elongate opening 12.

The elongate opening 12 of the cam lever 11 includes a generally arcuate long opening section 12A, and a generally radially extending short opening section 12B shorter than the long opening section 12A. The long opening section 12A has an end portion (not identified) merges to the short opening section 12B, and the other end portion 12D opposite to the end portion merging to the short opening section 12B. The long opening section 12A and the short opening section 12B are defined by an endless periphery which corresponds to the endless cam surface. The cam surface has a generally V-shaped (in section) curved or bent section 12C located at a position where the end portion of the long opening section 12A connects or merges to a radially outer end portion of the short opening section 12A.

The long opening section 12A has generally parallel two arcuate radially outer and inner peripheries P1, P2. The long opening section 12A has the following dimensions: The radial distance of the outer periphery Pi from the rotational center axis O takes the maximum value L1 at its end portion close to the bent section 12C, while the same distance takes the minimum value L2 at its end portion 12D. Thus, the long opening section 12A is formed generally arcuate to have a certain radius of curvature. By this, the roller 17 attached to a load lever 14 which will be discussed after is smoothly guided along the outer and inner peripheries P1, P2 of the long opening section 12A between the bent section 12D and the end portion 12D.

The short opening section 12B extends generally radially and has the radially outer end portion which is the most separate from the rotational center axis O or the fitting hole 11A, and a radially inner end portion (not identified) which is close to the rotational center axis O or the fitting hole 11A as compared with the outer end portion. Additionally, a bent claw section 11B is formed integral with the cam lever 11 and located generally radially separate from the fitting hole 11A and generally on the opposite side of the fitting hole 11A with respect to the elongate opening 12. The bent claw section 11B is arranged to be brought into contact with a stopper 20 which will be discussed after, thereby restricting the closing position of the throttle valve 3 as indicated by solid lines in FIG. 6.

A fixed pin 13 projects from the gear casing 1C and is located separate from the cam lever 11 in the generally radial direction of the cam lever 11. The load lever 14 serving as a cam follower is rotatably mounted through a bearing 15 or the like on the fixed pin 13. The load lever 14 is formed of a high strength metal sheet or plate and biased by a spring 18 which will be discussed after, so that a biasing force (rotational force) indicated by an arrow C in FIG. 2 is applied to the load lever 14. The roller 17 is rotatably attached through a support shaft 16 to the tip end section of the load lever 14, and rotatably inserted in the elongate opening 12 so as to be contact with the cam surface of the elongate opening 12.

Here, the roller 17 of the load lever 14 is always brought into press contact with the periphery (including the outer periphery P1) of the elongate opening 12 under the biasing force indicated by the arrow C and due to the spring 18. Accordingly, when the cam lever 11 is rotated in the direction indicated by the arrow A, B, the biasing force (or reaction) of the spring 18 is applied through the roller 17 to the cam lever 11. The roller 17 rotates upon contacting with the inner periphery (defining the elongate opening 12) of the cam lever 11, thereby suppressing to a low level a frictional resistance between the cam lever 11 and the load lever 14 (the roller 17).

The load lever 14 is provided at its base section with a holding section 14A which is formed projecting and located generally on the opposite side of the fixed pin 13 with respect to the roller 17. An end section of a spring 18 is held to or caught by the holding section 14A. The load lever 24 is pivotally moved or rotated upon following the rotational movement of the cam lever 11 while the roller 17 is in contact with the periphery of the elongate opening 12, so that the spring 18 elastically deforms to extend or to receive a tensile force when a preset state shown in FIG. 2 changes to a state shown in FIG. 3 or a state shown in FIG. 4. The spring 18 serving as a biasing device is disposed inside the gear casing 1C and installed in its preset state between the holding section 14A of the load lever 14 and a catching projection 19 formed integral with the throttle body 1. The spring 18 is constituted of a tension spring and always applies the biasing force in the direction indicated by the arrow C to the load lever 14.

The spring 18 biases the load lever 14 in the direction indicated by the arrow C even when a rotational driving force from the electric motor 4 to the cam lever 11 is released, so that the cam lever 11 is compulsorily rotated to cause the roller 17 of the load lever 14 makes its relative displacement toward the bent section 12C of the elongate opening 12. By this, the cam lever 11 stops in rotational movement at a position where the roller 17 comes into contact with the bent section 12C of the elongate opening 12 as shown in FIG. 2. At this time, the throttle valve 3 is kept in an intermediately opened or partly opened position shown in FIG. 5. In other words, when the cam lever 11 is rotated in the direction indicated by the arrow A from the position shown in FIG. 2, the roller 17 of the load lever 14 is brought into contact with the periphery of the short opening section 12B of the elongate opening 12 as shown in FIG. 3, so that the throttle valve 3 is rotated to the closed position shown in FIG. 6. When the cam lever 11 is rotated in the direction indicated by the arrow B from the position shown in FIG. 2, the roller 17 of the load lever 14 is brought into contact with the periphery of the long opening section 12A of the elongate opening 12 as shown in FIG. 4, so that the throttle valve 3 is rotated to the fully opened position shown in FIG. 7.

A stopper 20 is provided to restrict the closed position of the throttle valve 3, and includes a stopper projection 21 which is located inside the gear casing 1C and formed integral with the throttle body 1 as shown in FIGS. 1 and 2. An eye bolt 22 is screwed in the stopper projection 21. A nut 23 is threadedly mounted on the eye bolt 22. The tip end section of the eye bolt 22 is contactable with the bent claw section 11B of the cam lever 11 as shown in FIG. 3, thereby preventing the throttle valve 3 from moving from the position indicated by the solid lines in FIG. 6 in the direction (indicated by an arrow A) to further close the throttle valve. Here, in this stopper 20, the projection amount of the eye bolt 22 in the direction toward the bent claw section 11B of the cam lever 11 can be suitably adjusted by changing the screwing position of the eye bolt 22 relative to the stopper projection 21 under a condition where the nut 23 is loosened. Thus, the closing position of the throttle valve 3 is variably adjusted in accordance with the projection amount of the eye bolt 22, for example, between the closed position indicated by the solid lines and the fully closed position indicated in phantom in FIG. 6.

Figure 6:
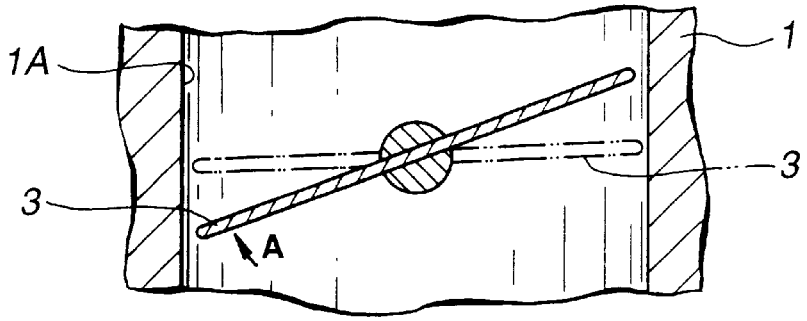
FIG. 6 is an enlarged sectional view similar to FIG. 5 but showing another state where the throttle valve is at the closing position.

It will be understood that the closed position indicated by the solid lines in FIG. 6 is obtained by changing the closed position of the throttle valve 3 by a certain angle relative to the fully closed position indicated in phantom in order to allow air in an amount corresponding to an idling speed of the engine to flow to the side of combustion chambers of the engine. Additionally, the nut 23 forming part of the stopper 20 is again threadedly mounted on the eye bolt 22 after adjustment of the projection amount of the eye bolt 22 thereby preventing the eye bolt 22 from being loosened.

A gear cover 24 is detachably installed to the gear casing 1C of the throttle body 1 to cover the reduction gear mechanism 5 and the like inside the gear casing 1C as shown in FIG. 1, thereby preventing rain water and the like from penetrating into the gear casing 1C. It will be understood that the throttle valve device D in FIGS. 2 to 4 is shown in a state where the gear cover 24 is removed from the gear casing 1C for the purpose of clearly disclosing the reduction gear mechanism 5 and the like.

An accelerator operation amount detecting device 25 is disposed to the throttle body 1 and includes a wire drum 26 as shown in FIG. 1. One end section of a wire 28 is fixed to and wound on the wire drum 26, while the other end section of the wire 28 is connected to an accelerator pedal (not shown) of the vehicle. The wire drum 26 is biased by a return spring 27. When a driver of the vehicle depressed or operates the accelerator pedal, the wire drum 26 is rotated against the bias of the return spring 27 by an amount corresponding to the accelerator operation amount (the operation amount of the accelerator pedal). The accelerator operation amount is detected by an operation amount sensor 30. A wire guide 29 is attached to the accelerator operation amount detecting device 25 to smoothly guide the wire 28 which is unwound from or wound on the drum 26.

The operation amount sensor 30 is constituted of a potentiometer and the like, and adapted to detect the rotational amount of the wire drum 26 as the accelerator operation amount so as to generate a detection signal representative of the accelerator operation amount. The detection signal is output to a control unit (not shown) for engine control. The control unit generate a driving signal corresponding to the accelerator operation amount in accordance with the detection signal and output the driving signal to the electric motor 4, thereby controllably rotating the electric motor 4. As a result, the throttle valve 3 is rotated by an amount corresponding to the accelerator operation amount through the reduction gear mechanism 5.

A throttle sensor 31 is disposed in the sensor casing 1D and constituted of a potentiometer and the like similarly to the operation amount sensor 30. The throttle sensor 31 is adapted to detect a rotational angle of the valve shaft 2 as an opening angle or throttle valve position which is referred hereinafter to as a "throttle opening degree".

The manner of operation of the above throttle valve device D will be discussed hereinafter.

First, when the driver of the vehicle depresses the accelerator pedal to make an accelerator operation, an operation or depression force applied to the accelerator pedal is transmitted through the wire 28 to the wire drum 26 of the accelerator operation amount detecting device 25 so that the wire drum 26 is rotated by an angle corresponding to the accelerator operation amount against the bias of the return spring 27.

Figure 5:
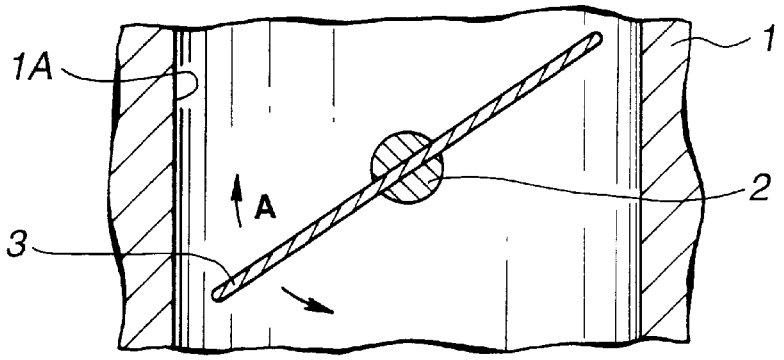
FIG. 5 is an enlarged sectional view showing a state where the throttle valve is at its intermediately or partly opened position.
Figure 7:
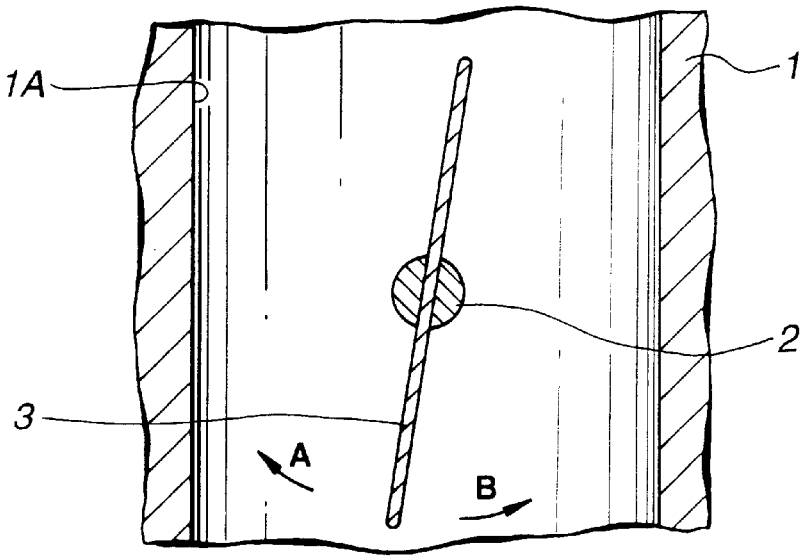
FIG. 7 is an enlarged sectional view similar to FIG. 5 but showing a further state where the throttle valve is at the fully opened position.
Figure 8:
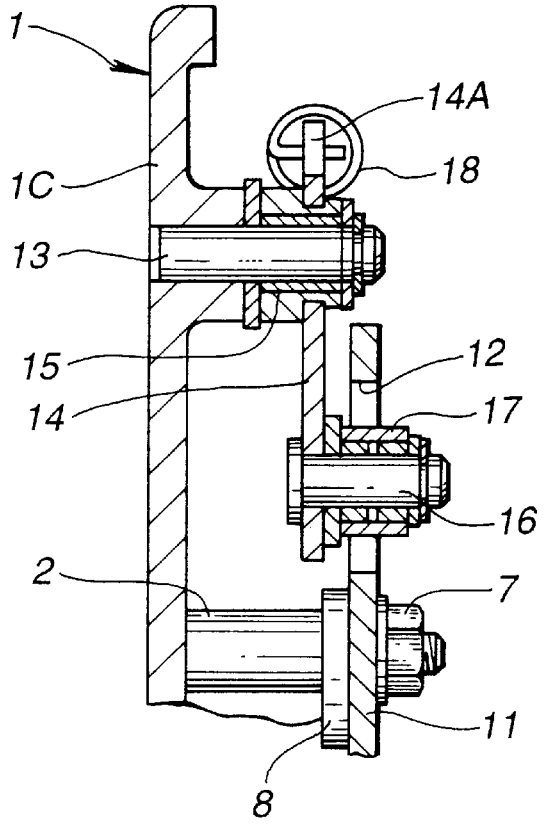
FIG. 8 is an enlarged sectional view taken in the direction of arrows substantially along the line 8—8 in FIG. 2.

When the operation amount sensor 30 detects the rotation (corresponding to the accelerator operation amount) of the wire drum 26, the detection signal from the operation amount sensor 30 is output to the control unit for engine control. Then, the control unit generates the driving signal corresponding to the accelerator operation amount in accordance with the detection signal, and outputs the driving signal to the electric motor 4. As a result, the electric motor 4 is rotatably driven in one direction. The rotational speed of the electric motor 4 is reduced by the reduction gear mechanism 5 so that a larger torque is transmitted to the valve shaft 2. Accordingly, the throttle valve 3 is rotated together with the valve shaft 2 as a one-piece member as shown in FIGS. 5 to 7, in which the opening degree of the throttle valve 3 is controlled corresponding to the accelerator operation amount.

Additionally, the cam lever 11 fixed together with the driven gear 8 on the valve shaft 2 is rotatable together with the valve shaft 2 as a one-piece member. At the fully opened position of the throttle valve 3 as shown in FIG. 7, the cam lever 11 is also rotated in the direction indicated by the arrow B, so that the load lever 14 is rotated as shown in FIG. 4 along the long opening section 12A of the elongate opening 12 whose periphery constitutes the cam face. This increases the biasing force of the spring 18. At the closed position of the throttle valve 3 as shown in FIG. 6, the cam lever 11 is rotated together with the valve shaft 2 in the direction indicated by the arrow A, so that the load lever 14 is also rotated along the short opening section 12B of the elongate opening 12 as shown in FIG. 3.

When a rotational driving force to the reduction gear mechanism 5 is released by interrupting power supply to the electric motor 4 at stoppage or the like of the engine, a rotational force in the direction indicated by the arrow C is applied to the load lever 14 and around the fixed pin 13. Then, the load lever 14 causes the cam lever 11 to make its relative rotation in such a manner that the roller 17 is guided to the bent section 12C of the cam surface of the elongate opening 12. By this, the cam lever 11 makes its stop in rotation at a position where the roller 17 comes into contact with the bent section 12C of the cam surface of the elongate opening 12 as shown in FIG. 2. At this time, the throttle valve 3 is kept in the intermediately (partially) opened position shown in FIG. 5.

In other words, the cam lever 11 is fixedly mounted through its fitting hole 11A (through which the rotational center axis O passes) on the valve shaft 2 in such a manner to be prevented from movement relative to the valve shaft 2. As shown in FIG. 9, the long opening section 12A and the short opening section 12B of the elongate opening 12 are formed to have such a shape that the radial distance of the outer periphery P1 of the long opening section 12A takes the maximum value L1 at the end portion close to the bent section 12C, in which the same radial distance gradually decreases toward the other end portion 12D. As a result, when the rotational force of the electric motor 4 is released, the cam lever 11 is automatically rotated into the position as shown in FIG. 2 under the bias of the spring 18 applied through the load lever 14, thereby automatically returning the throttle valve 3 in its intermediately opened position as shown in FIG. 5.

According to this embodiment, the motor storing casing 1B is formed within the throttle body 1 and separate from the throttle chamber 1A, in which the electric motor 4 is disposed inside the motor storing casing 1B. Additionally, the output shaft 4A of the electric motor 4 is projected into the gear casing 1C formed at one side of the throttle body 1, while the reduction gear mechanism 5 is disposed between the output shaft 4A and the valve shaft 2 for the throttle valve 3. With this configuration, the rotational speed of the electric motor 4 is reduced by the reduction gear mechanism 5 so as to generate a larger rotational torque at the valve shaft 2. As a result, the throttle valve 3 can be securely operated to open or close through the valve shaft 2 even in case that the electric motor 4 is small-sized and low in output torque. Accordingly, it is made possible to use a small-sized motor as the electric motor 4 thereby achieving energy saving and a smooth control for intake air amount in accordance with the opening degree of the throttle valve 3.

Further, in this embodiment, the reduction gear mechanism 5 is disposed inside the gear casing 1C of the throttle body 1 and is constituted of the drive gear 6, the driven gear 8 and the intermediate gear 9. The drive gear 6 is fixedly mounted on the output shaft 4A of the electric motor 4. The driven gear 8 is fixedly mounted on the valve shaft 2. The intermediate gear 9 includes the large-diameter gear 9A engaged with the drive gear 6, and the small-diameter gear 9B engaged with the driven gear 8. With this configuration, the speed reduction ratio of the reduction gear mechanism 5 can become high or large, while the reduction gear mechanism 5 can be compactly encased inside the gear casing 1C thereby making the whole throttle valve device D small-sized and light in weight.

Furthermore, the cam lever 11 is fixed on the one end section of the valve shaft 2 upon being tightly interposed between the driven gear 8 and the nut 7 inside the gear casing 1C, while the load lever 14 is pivotally disposed through the fixed pin 13 and the like so that the roller 17 at the tip end section of the load lever 14 is inserted in the elongate opening 12 of the cam lever 11, serving as the cam follower. Additionally, the load lever 14 is provided with the single spring 18 for always biasing the roller 17 to the periphery of the elongate opening 12 so that the load lever 14 is biased toward the bent section 12C of the cam surface of the elongate opening 12 under the action of the spring 18 when the driving force of the electric motor 4 is released.

By this, the rotational driving force from the electric motor 4 is transmitted through the reduction gear mechanism 5 to the valve shaft 2 and the cam lever 11, in which the cam lever 11 is rotated between the closed position and the fully closed position of the throttle valve 3. Additionally, the load lever 14 can be rotated upon being guided along the elongate opening 12 against the bias of the spring 18, thereby continuously applying the biasing force of the spring 18 to the cam lever 11 as a reaction during rotation.

Furthermore, when the driving force of the electric motor is lost owing to stoppage of the engine (interruption of power supply to the electric motor 4) or trouble or the like of the electric motor 4, the single spring 18 biases the roller 17 of the load lever 14 toward the bent section 12C of the cam lever 11, so that the cam lever 11 can be compulsorily rotated through the load lever 14. As a result, the rotational movement of the cam lever 11 can be stopped at the position where the roller 17 of the load lever 14 is brought into contact with the bent section 12C of the cam surface of the cam lever 11, while the throttle valve 3 can be automatically returned to the intermediately (partly) opened position as shown in FIG. 5 under such a condition.

As a result, even in case that the vehicle is left as it is upon the engine being stopped in a cold district, the throttle valve 3 can be kept in the intermediately opened position, and therefore the throttle valve 3 is prevented from becoming immovable under freezing thereby improving engine starting ability at low temperatures, engine reliability and the like. Additionally, even in case that the electric motor 4 is in trouble, the throttle valve 3 can be kept in the intermediately opened position, and therefore it is possible to continuously supply the minimum amount of intake air to the engine so that the vehicle can continuously run at a low speed, for example, toward an auto repair shop.

Accordingly, with the above embodiment of the present invention, the throttle valve 3 can be continuously kept at the intermediately opened position by using only the single spring 18 in case of power supply stop, trouble or the like of the electric motor 4. This can reduce the number of parts of the throttle valve device D thereby improving the operational efficiency during assembly of the throttle valve device D, and makes the whole throttle valve device 3 small-sized and formed compact, while stabilizing an opening adjustment of the throttle valve 3.

Since the cam lever 11 is configured to be detachably mounted on the one end section of the valve shaft 2 of the cam lever 11, the opening degree of the throttle valve 3 at the intermediately opened position can be easily altered merely by changing the cam lever 11 upon preparing a plurality of cam levers (11) which are different in shape of the cam surface defined by the elongate opening 12. This can readily deal with change in engine specification, vehicle kind or the like which requires change in opening degree of the throttle valve 3 at the intermediately opened position.

Further, the elongate opening 12 of the cam lever 11 is provided with a function as a stopper for determining the maximum and minimum opening degrees of the throttle valve 3 by means of the elongate opening 12 of the cam lever 11, so that no special stopper or the like is necessary to be provided. Besides, by bringing the bent claw section 11B of the cam lever 11 into contact with the eye bolt 22 of the stopper 20 at the closed position of the throttle valve 3, the opening degree of the throttle valve 3 at the closed position can be variably changed thereby making it possible to adjust the idling engine speed of the engine by changing the amount of projection of the eye bolt 22 from the stopper projection 21.

FIGS. 13 to 17 illustrate a second embodiment of the throttle valve device D according to the present invention, which is similar to the first embodiment of FIGS. 1 to 12 with the exception that a driven gear section 43 is fixed to the cam lever 11 which corresponds to the cam lever 11 of the first embodiment so that the driven gear 8 in the first embodiment is omitted.

In this embodiment, the driven gear section 43 is formed fixed to or integral with the cam lever 11 by means of welding or the like and located generally radially separate from the rotational center axis O or the fitting hole 11A. The driven gear section 43 is formed generally arcuate and fixedly secured to the peripheral section of the cam lever 11. The driven gear section 43 is formed of a hard metal material. The rotational center axis of the driven gear section 43 corresponds to the rotational center axis O of the cam lever 11. The driven gear section 43 is formed at its outer peripheral portion with gear teeth and positioned generally peripherally separate from the elongate opening 12. The driven gear section 43 together with the drive gear 6 and the intermediate gear 9 constitute the reduction gear mechanism 5 like the driven gear 8 in the first embodiment. Thus, the driven gear section 43 is in engagement with the small-diameter gear section 9B of the intermediate gear 9.

Figure 14:
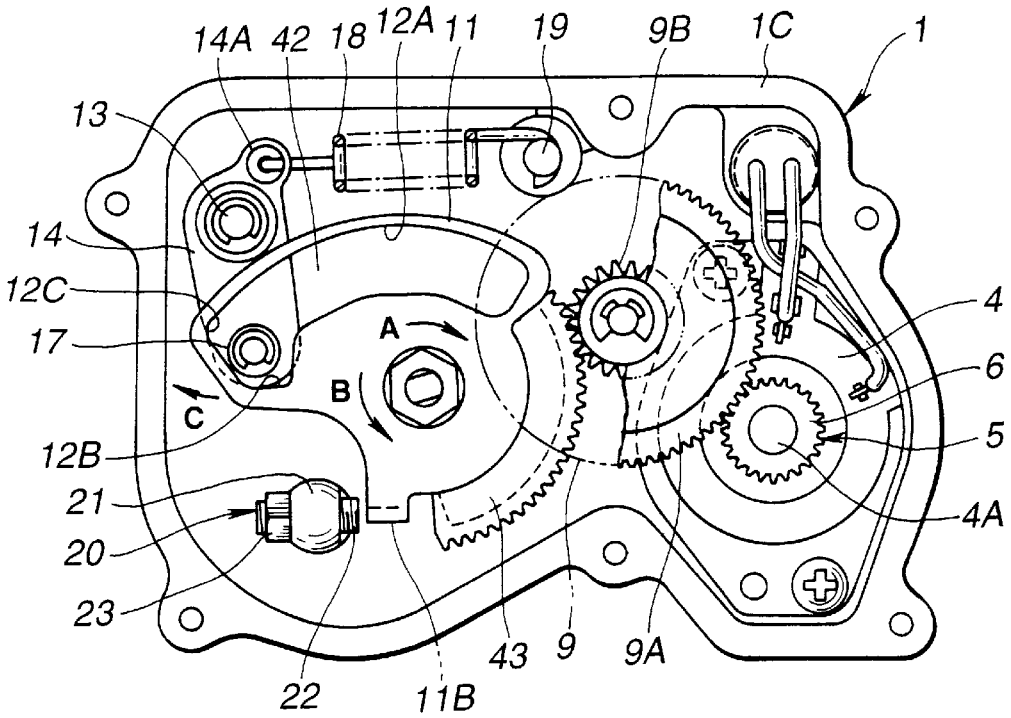
FIG. 14 is an enlarged front view similar to FIG. 13 but showing a state where a throttle valve is rotated to its closed position.
Figure 15:
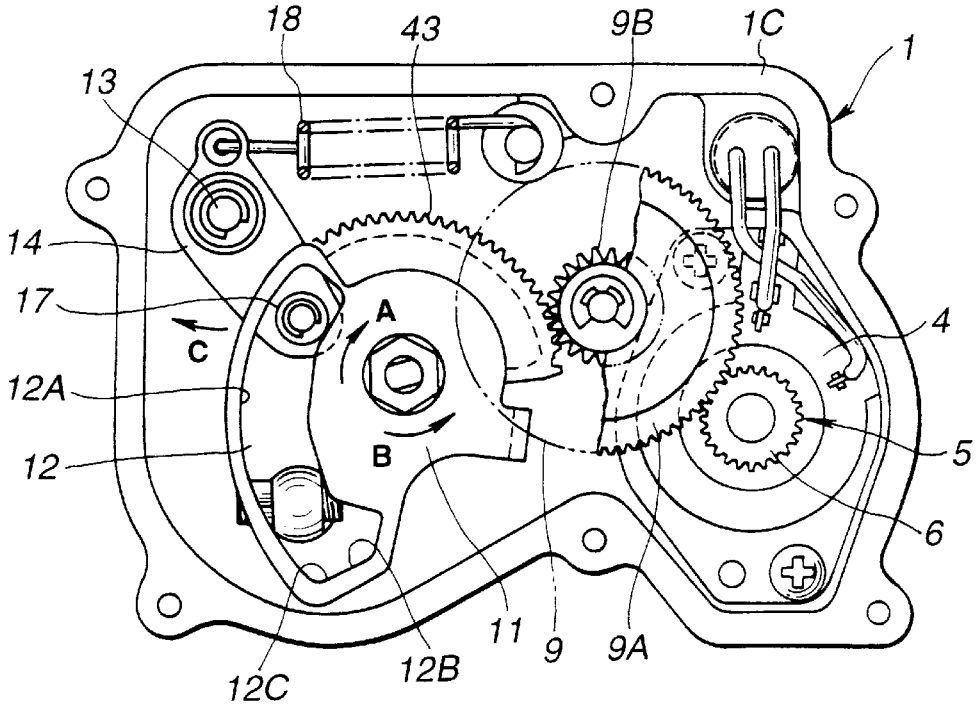
FIG. 15 is an enlarged front view similar to FIG. 13 but showing another state where the throttle valve is rotated to its fully opened position.
Figure 16:
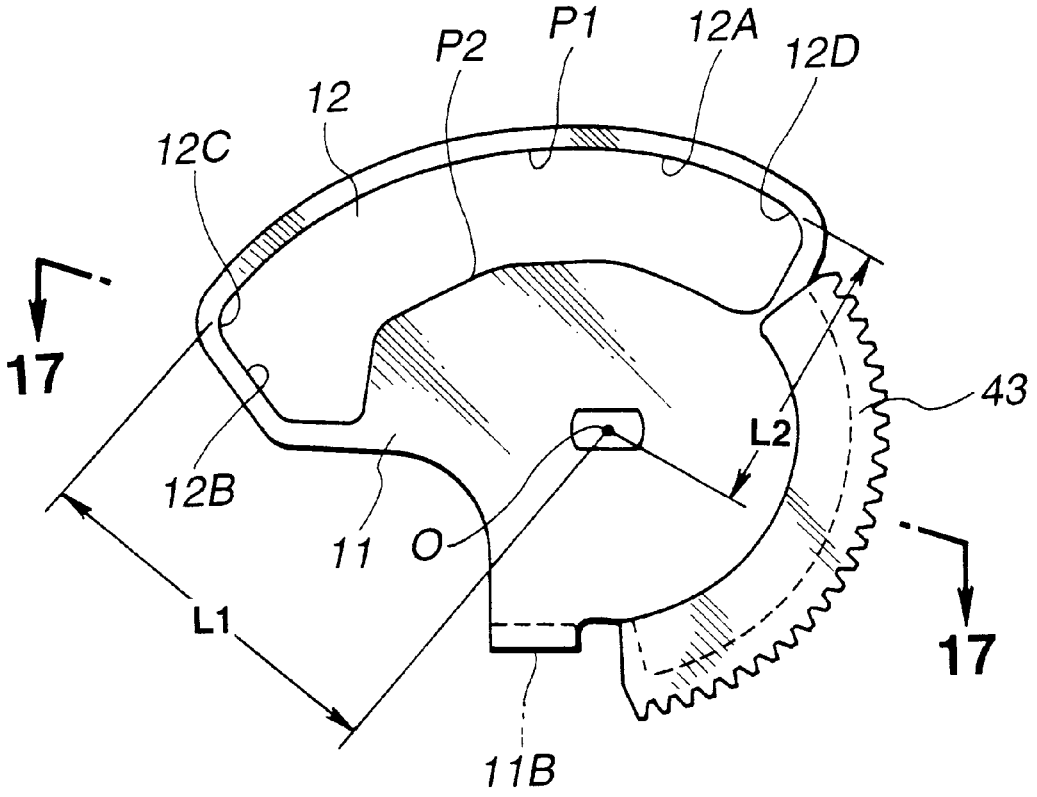
FIG. 16 is an enlarged sectional view of a cam lever incorporated with a driven gear section, used in the throttle valve device of FIG. 13.
Figure 17:
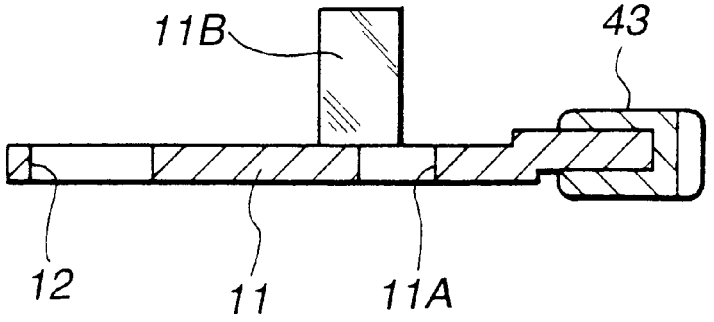
FIG. 17 is a sectional view taken in the direction of arrows substantially along the line 17—17 of FIG. 16.

Also with this embodiment, the cam lever 11 and the load lever 14 are rotated against the bias of the spring 18 at the closed position of the throttle valve 3 as shown in FIG. 14. Additionally, the cam lever 14 and the load lever 14 are rotated against the bias of the spring 18 at the opened position of the throttle valve 3 as shown in FIG. 15. Further, when the throttle valve 3 is kept at the intermediately opened position, the cam lever 11 is automatically rotated to a position shown in FIG. 13 through the load lever 14 under the bias of the spring 18. Thus, it will be appreciated that this embodiment can provide the substantially same effects as those of the first embodiment.

In this embodiment, the driven gear section 43 is formed integral with the outer peripheral section of the cam lever 11, and therefore the cam lever 11 and the driven gear 43 can be treated as a single part, thereby reducing the number of parts and improving operational efficiency during assembly of the throttle valve device D.

FIGS. 18 to 30 illustrate a third embodiment of the throttle valve device D according to the present invention, which is similar to the first embodiment of FIGS. 1 to 13. In this embodiment, the throttle valve device D comprises the throttle body 1 which serves as an outer shell of the throttle valve device D and is formed by using aluminum die-casting or the like. The throttle body 1 is formed thereinside with the generally cylindrical throttle chamber 1A which serves as a part of an intake air passageway communicated with the inside of each cylinder (not shown) of the engine. The motor storing casing 1B is formed integral with the main section (not identified) of the throttle body 1 defining the throttle chamber 1A so as to form a part of the throttle body 1, in which the motor storing casing 1B is separate a certain distance from the throttle chamber 1A. Additionally, the gear casing 1C is formed integral with the main section of the throttle body 1 and located at the side of an end section of the throttle shaft 2. Further, the sensor casing 1D is formed integral with the main section of the throttle body 1 and located at the side of the other end section of the throttle shaft 2.

The throttle shaft 2 is disposed rotatable through bearings or the like in the throttle body 1. The throttle shaft 2 is formed of a high strength metal rod or the like and extends diametrically through the throttle chamber 1A of the throttle body 1. The one end section of the throttle shaft 2 projects into the gear casing 1C while the other end section projects through the sensor casing 1D. The throttle valve or disc 3 is fixedly or integrally mounted on the axially central section of the throttle shaft 2 so as to be driven to open or close under the action of the throttle shaft 2. The throttle valve 3 is rotatably disposed in the throttle chamber 1A of the throttle body 1 and constituted of the disc-shaped valve plate. The throttle valve 3 has the diameter generally corresponding to the inner diameter of the throttle chamber 1A. The throttle valve 3 is rotatable around the axis of the valve shaft 2 so as to take the fully closed position indicated in phantom in FIG. 23 and the fully opened position in FIG. 24. In other words, the throttle valve 3 is rotatable between the fully closed position and the fully opened position, thereby variably controlling the amount of intake air to be supplied to the engine in accordance with the opening degree of the throttle valve 3.

The electric motor 4 is encased in the motor storing casing 1B so as to serve as the driving device, and is, for example, a D.C. motor. The electric motor 4 has the output shaft 4A which projects to the side of the gear casing 1C. The output shaft 4A is driven to rotate under power supply to the electric motor 4 from the outside so as to cause the valve shaft 2 to rotate in directions indicated by arrows A, B in FIG. 19 through the reduction gear mechanism 5, thus opening and closing the throttle valve 3.

Figure 19:
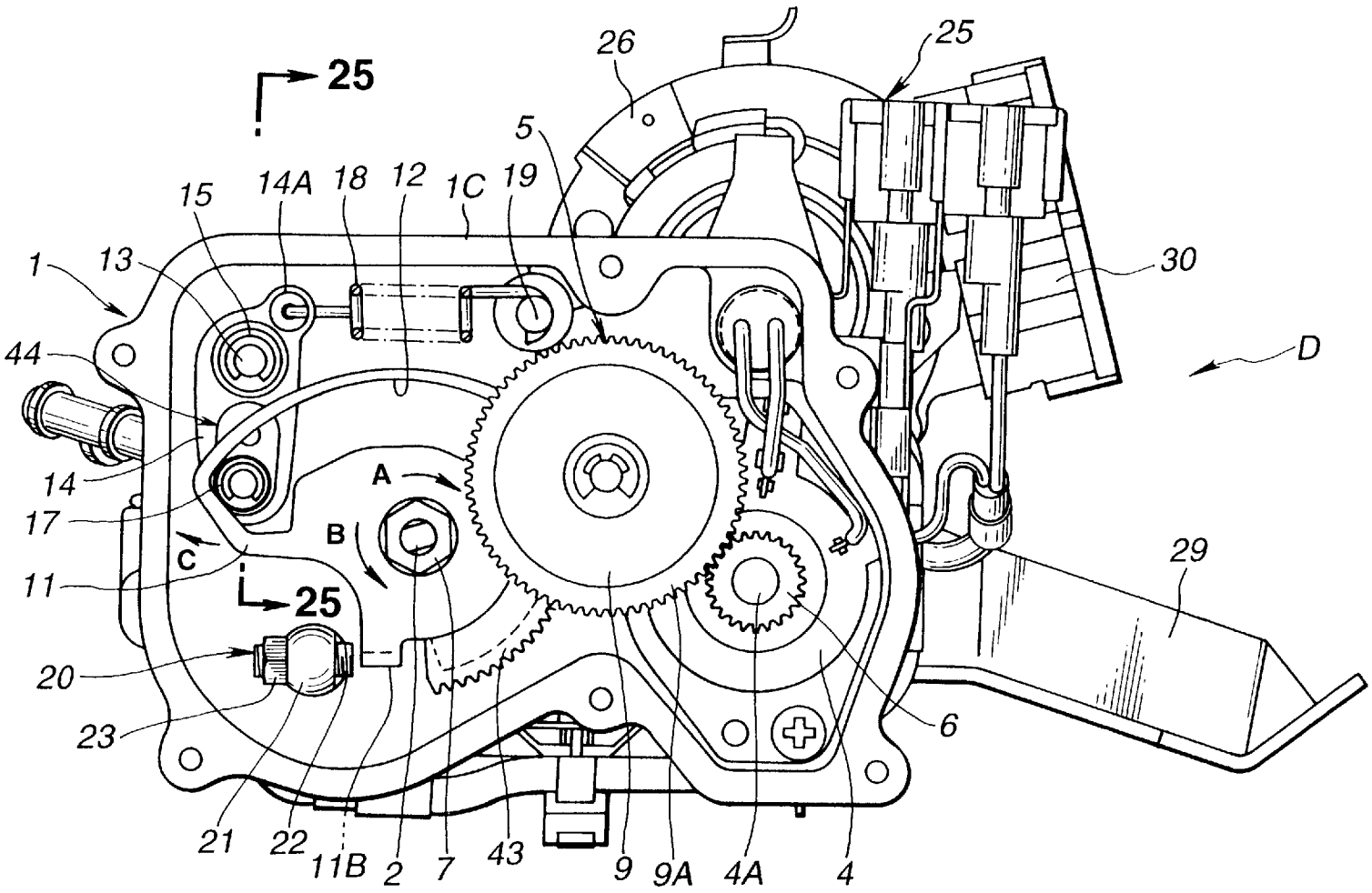
Figure 20:
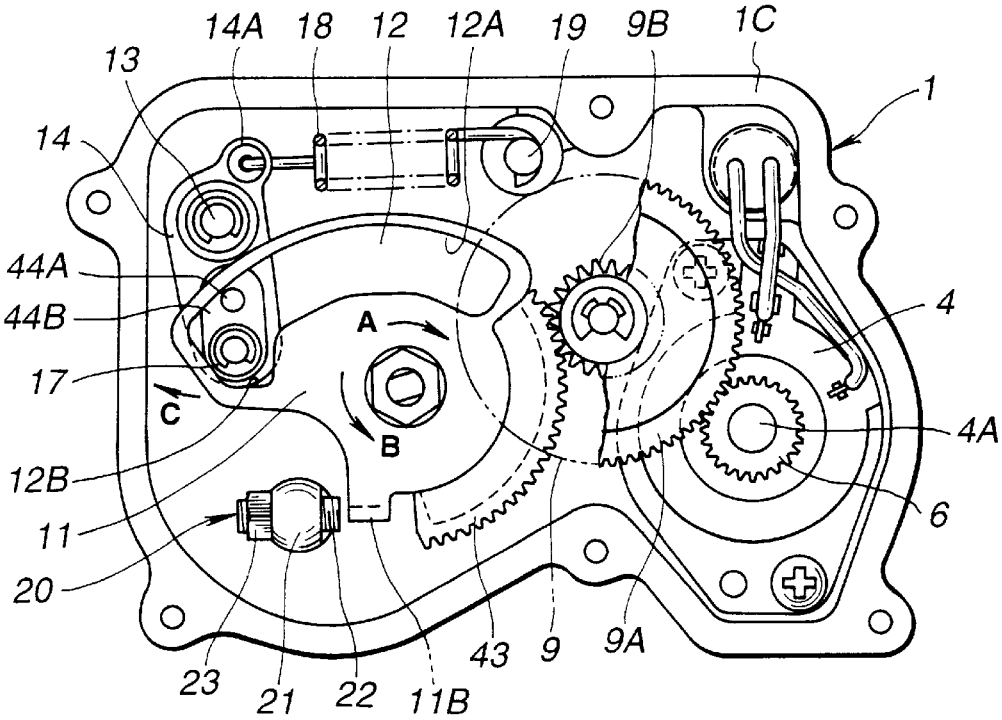
FIG. 20 is an enlarged front view similar to FIG. 19 but showing a state where a throttle valve is rotated to its closed position.
Figure 21:
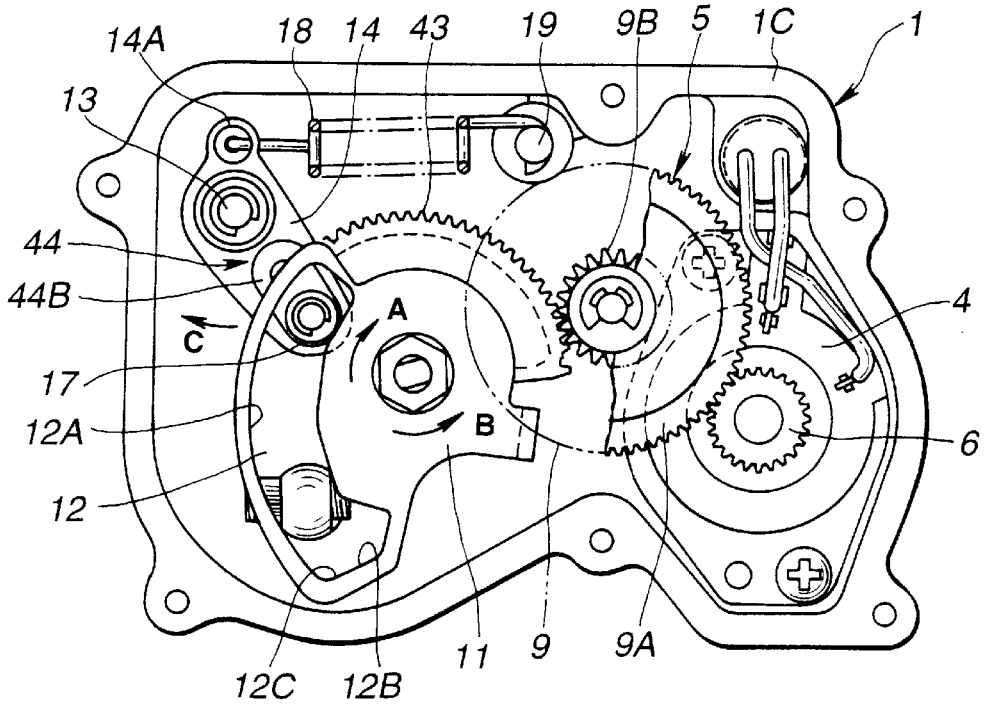
FIG. 21 is an enlarged front view similar to FIG. 19 but showing another state where the throttle valve is rotated to its fully opened position.

The reduction gear mechanism 5 is located inside the gear casing 1C and disposed between the output shaft 4A of the electric motor 4 and the throttle shaft 2. As shown in FIGS. 19 to 21, the reduction gear mechanism 5 includes the small-diameter drive gear 6 fixedly mounted on the output shaft 4A of the electric motor 4. The driven gear section 43 is fixedly secured to or formed integral with the cam lever 11 by means of welding or the like. The cam lever 11 is fixedly mounted on the one end section of the valve shaft 2 under the action of the nut 7. The intermediate gear 9 is disposed between the drive gear 6 and the driven gear 8. The reduction gear mechanism 5 functions to make a speed-reduction of rotation of the output shaft 4A of the electric motor 4 under the combination of the drive gear 6 and the intermediate gear 9, and another speed-reduction under the combination of the intermediate gear 9 and the driven gear section 43, so that a greater rotational force is transmitted to the valve shaft 2 of the throttle valve 3.

More specifically, the driven gear section 43 is constituted of a gear member and formed arcuate having a rotational center axis corresponding to the rotational center axis O of the cam lever 11. The driven gear section 43 is located generally radially separate from the fitting hole 1A or the rotational center axis O and generally peripherally separate from the elongate opening 12 of the cam lever 11. The driven gear section 43 is fixedly secured to the outer peripheral section of the cam lever 11, and is formed as a part of a gear having a larger diameter than the small diameter gear section 9B of the intermediate gear 9. The driven gear section 43 can be rotated together with the cam lever 11 as an one-piece member by tightening the cam lever 11 on the one end section of the valve shaft 2 with the nut 7.

Figure 18:
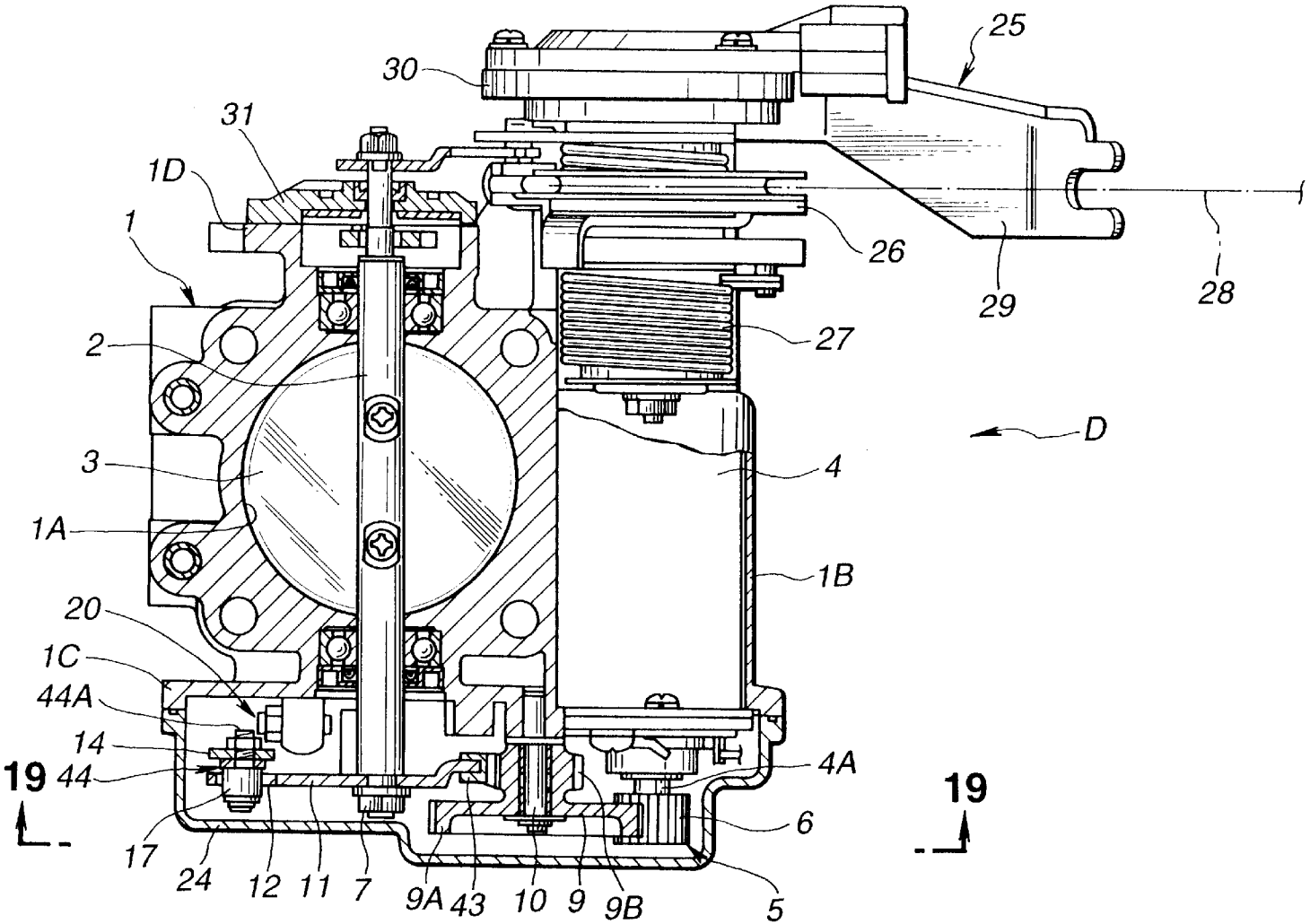
FIG. 18 is a vertical sectional view of a third embodiment of the throttle valve device according to the present invention.

The intermediate gear 9 forming part of the reduction gear mechanism 5 is disposed between the drive gear 6 and the driven gear 8 and is rotatably attached through the support shaft 10 to the gear casing 1C of the throttle body 1 as shown in FIG. 18. The intermediate gear 9 includes the large-diameter gear section 9A and the small-diameter gear section 9B which are integral with each other. The large-diameter gear section 9A is in engagement with the drive gear 6 to have a certain speed reduction ratio as shown in FIG. 19. The small-diameter gear section 9B of the intermediate gear 9 is in engagement with the driven gear 8 to have a certain speed reduction ratio thereby providing a larger rotational torque to the driven gear 8, as shown in FIGS. 20 and 21.

Figure 27:
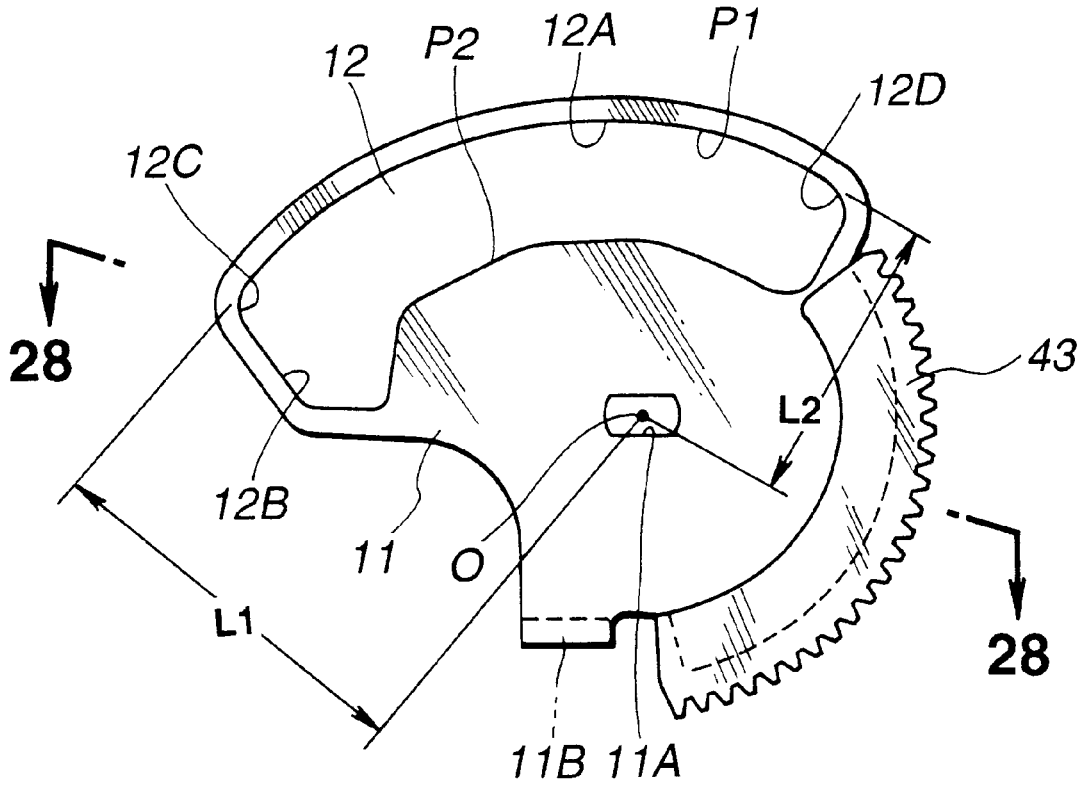
FIG. 27 is an enlarged front view of the cam lever incorporated with a driven gear section, used in the throttle valve device of FIG. 18.
Figure 28:
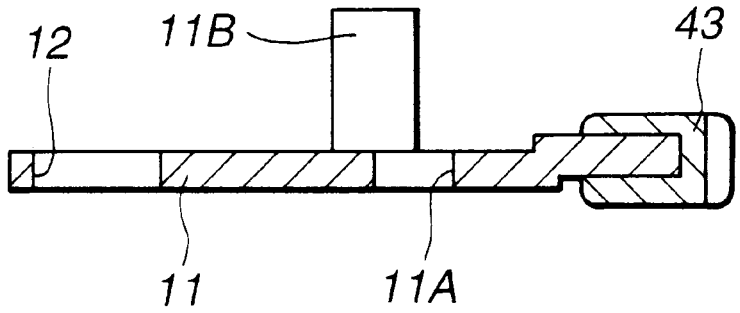
FIG. 28 is a sectional view taken in the direction of arrows substantially along the line 28—28 of FIG. 27.

The cam lever 11 is fixedly mounted together with the driven gear 8 on the one end section of the valve shaft 2. As shown in FIGS. 27 and 28, the cam lever 11 is formed generally sector-shaped by pressing a high strength metal sheet or plate, in which the non-circular fitting hole 11A is formed at a section through which the rotational center axis O of the cam lever 11. The cam lever 11 is fitted together with the driven gear 8 on the one end section of the valve shaft 2 in such a manner as to be prevented from rotating relative to the valve shaft 2. Additionally, the cam lever 11 is tightened on the valve shaft 2 under the action of the nut 7 as shown in FIG. 18. As discussed above, the arcuate drive gear section 43 is combined with the outer peripheral section of the cam lever 11 by means of welding or the like.

The cam lever 11 is formed with the elongate opening 12 which is formed generally radially separate from the fitting hole 11A, in which the inner periphery of the elongate opening 12 constitutes the cam surface. The roller 17 is rotatably disposed inside the elongate opening 12 in such a manner that the roller 17 relatively moves on the cam surface along the inner periphery defining the elongate opening 12. The elongate opening 12 of the cam lever 11 includes the generally arcuate long opening section 12A, and the generally radially extending short opening section 12B shorter than the long opening section 12A. The long opening section 12A has the end portion (not identified) merges to the short opening section 12B, and the other end portion 12D opposite to the end portion merging to the short opening section 12B. The long opening section 12A and the short opening section 12B are defined by an endless periphery which corresponds to the endless cam surface. The cam surface has the generally V-shaped (in section) curved or bent section 12C located at the position where the end portion of the long opening section 12A connects or merges to the radially outer end portion of the short opening section 12A.

The long opening section 12A has the generally parallel two arcuate radially outer and inner peripheries P1, P2. The long opening section 12A has the following dimensions: The radial distance of the outer periphery P1 from the rotational center axis O takes the maximum value L1 at its end portion close to the bent section 12C, while the same distance takes the minimum value L2 at its end portion 12D. Thus, the long opening section 12A is formed generally arcuate to have a certain radius of curvature. By this, the roller 17 attached to the load lever 14 is smoothly guided along the outer and inner peripheries P1, P2 of the long opening section 12A between the bent section 12D and the end portion 12D.

The short opening section 12B extends generally radially and has the radially outer end portion which is the most separate from the rotational center axis O or the fitting hole 11A, and the radially inner end portion (not identified) which is close to the rotational center axis O or the fitting hole 11A as compared with the outer end portion. Additionally, the bent claw section 11B is formed integral with the cam lever 11 and located generally radially separate from the fitting hole 11A and generally on the opposite side of the fitting hole 11A with respect to the elongate opening 12. The bent claw section 11B is arranged to be brought into contact with the stopper 20, thereby restricting the closing position of the throttle valve 3 as indicated by solid lines in FIG. 23.

The fixed pin 13 projects from the gear casing 1C and is located separate from the cam lever 11 in the generally radial direction of the cam lever 11. The load lever 14 serving as a cam follower is rotatably mounted through a bearing 15 or the like on the fixed pin 13. The load lever 14 is formed of a high strength metal sheet or plate and is formed at its base section with the holding section 14A which is located on the opposite side of the fixed pin 13 with respect to the roller 17. The spring 24 is caught or held by the fixed to the holding section 14A, so that the biasing force (rotational force) indicated by an arrow C in FIG. 19 is applied to the load lever 14.

Figure 26:
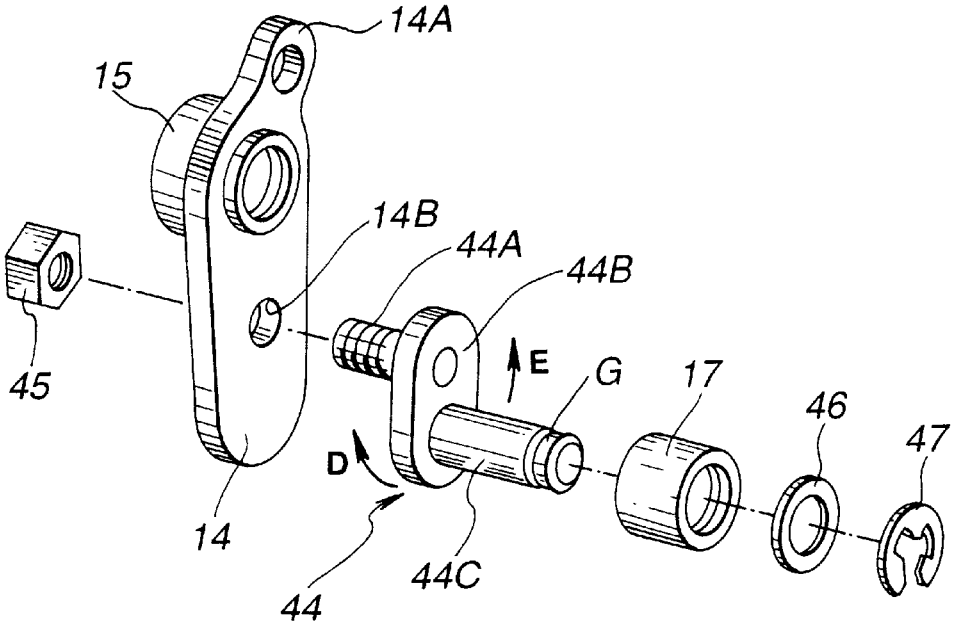
FIG. 26 is an enlarged exploded perspective view of an adjustment member in a state before being installed to a cam lever, used in the throttle valve device of FIG. 18.

Further, as shown in FIG. 26, the load lever 14 is formed with the small diameter insertion hole 14B which is located on the opposite side of the bearing 15 with respect to the holding section 14A. An adjustment member 44 for adjusting the intermediately opened position of the throttle valve 3 is provided including a installation screw section 44A which is inserted into the insertion hole 14B so as to be fixed to the load lever 14 by tightening a nut 45 threadedly mounted on the installation screw section 44A. In this embodiment, the roller 17 is rotatably mounted on the adjustment member 44. Accordingly, the roller 17 is kept in contact with the cam surface or the periphery of the elongate opening 12 so as to be rotated following the rotational movement of the cam lever 11, in which the spring 18 elastically deforms to extend or to receive a tensile force when a preset state shown in FIG. 19 changes to a state shown in FIG. 20 or a state shown in FIG. 21.

The adjustment member 44 is adjustably mounted on the load lever 14 and includes an adjustment plate 44B formed of a generally oval-shaped metal plate. The installation screw section 44A serving as an installation shaft is fixed to and projects in one direction from the adjustment plate 44B. The installation screw section 44A has an outer diameter which generally corresponds to the inner diameter of the insertion hole 14B. The nut 45 is screwed on the tip end section of the installation screw section 44A which is in a state to be inserted into the insertion hole 14B, so as to tightly install the adjustment plate 44B to the load lever 14. A support shaft section 44C is fixed to the other end section of the adjustment plate 44B and projects in the opposite direction to the installation screw section 44A. The roller 17 is rotatably mounted on the support shaft section 44C. The support shaft section 44C is formed at the peripheral surface of its tip end portion with a ring groove G to which a generally C-shaped stop member 47 is detachably fitted. The roller 17 is prevented from coming out of the support shaft section 44A by fitting the stop member 47 in the ring groove G through a plastic ring 46 or the like. The roller 17 is located eccentric a certain distance relative to or separate a certain distance from the installation screw section 44A on the adjustment plate 44B. As a result, when the intermediately opened position of the throttle valve 3 is adjusted, the adjustment plate 44B is rotated around the installation screw section 44A in directions indicated by arrows D and E in FIG. 26.

Figure 29:
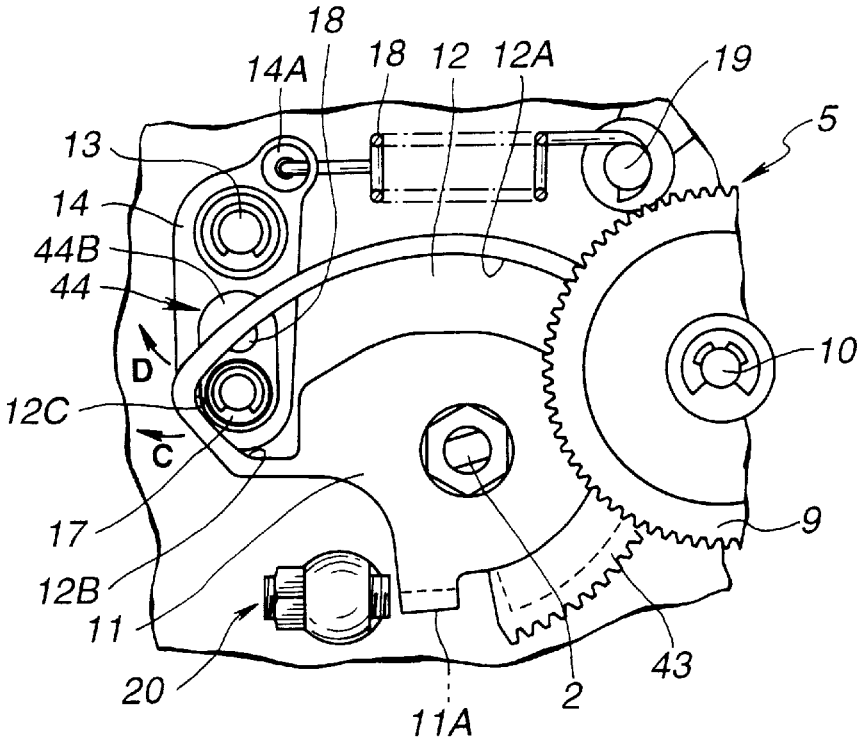
FIG. 29 is a fragmentary enlarged view illustrating a part of FIG. 19 but showing a state where the adjustment member is in a position.
Figure 30:
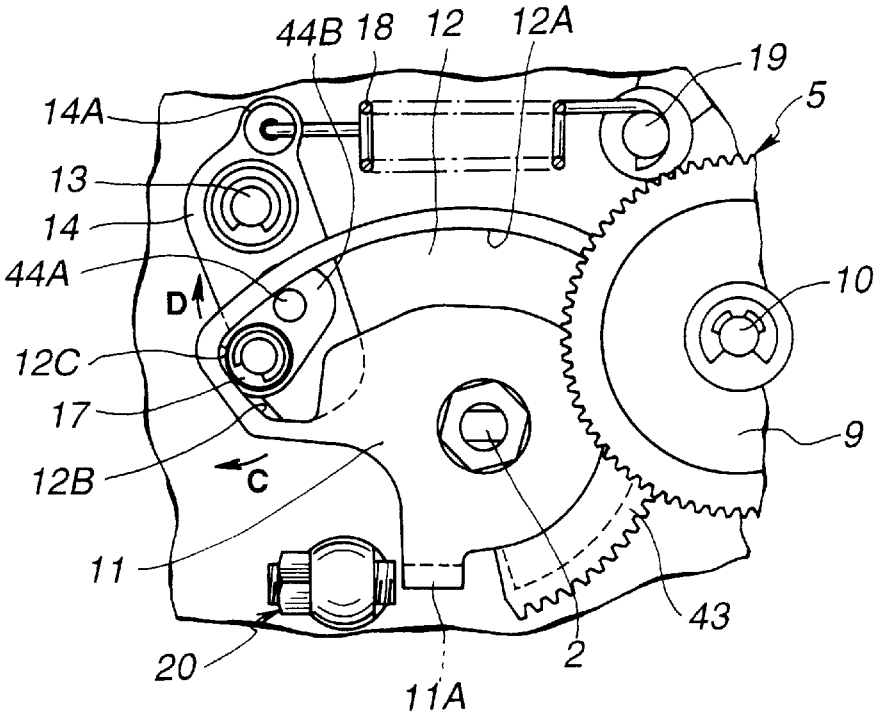
FIG. 30 is a fragmentary enlarged view similar to FIG. 29 but showing another state where the adjustment member is locationally changed relative to that in FIG. 29.
Figure 31:
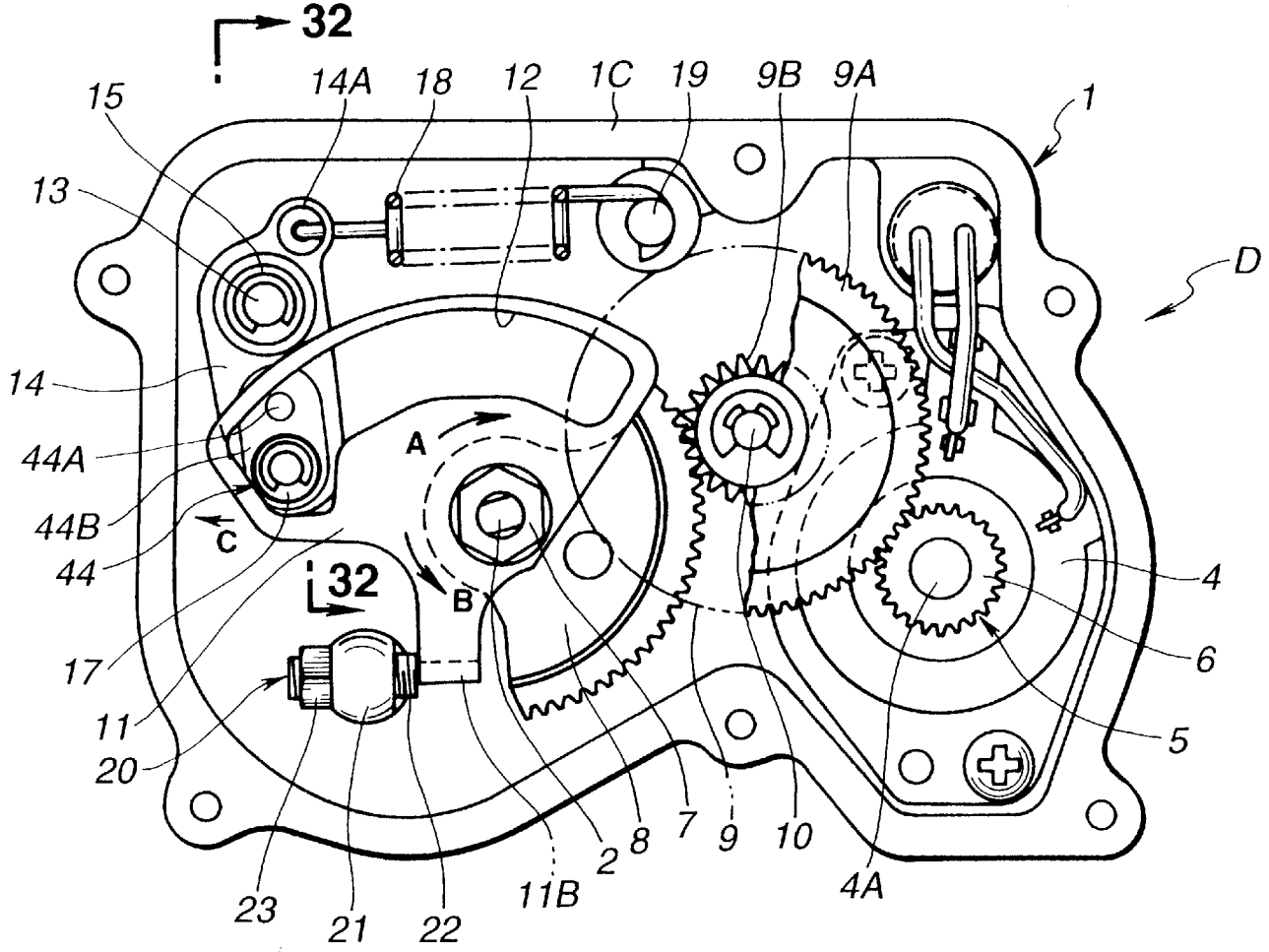
FIG. 31 is an enlarged front view similar to FIG. 20 but showing a fourth embodiment of the throttle valve device according to the present invention.

By this, the installation position of the adjustment member 44 relative to the load lever 14 is adjusted so that the location of the roller 17 relative to the load lever 14 can be changed as shown in FIGS. 29 and 30. The nut 45 is again screwed on the installation screw section 44A after the installation position of the roller 17 and the like are adjusted, in which the load lever 14 is tightly interposed between the adjustment plate 44B and the nut 45 thereby preventing the installation location of the roller 17 and the like from shifting so as to provide a loosening preventing function to the installation screw section 44A.

Here, the biasing force of the spring 18 in the direction indicated by the arrow C is applied through the load lever 14 to the roller 17 attached to the adjustment member 44, so that the roller 17 is always biased against the periphery or cam surface of the elongate opening 12. When the cam lever 11 is rotated in the directions indicated by the arrows A, B, the biasing force of the spring 18 acts as a reaction against the rotational movement of the cam lever 11. At this time, the roller 17 rotates upon being in contact with the periphery or cam surface of the elongate opening 12, and therefore the frictional resistance between the cam lever 11 and the adjustment member 16 (or the roller 17) is suppressed at a low level.

The spring 18 serving as the biasing device is disposed inside the gear casing 1C and installed in its preset state between the holding section 14A of the load lever 14 and the catching projection 19 formed integral with the throttle body 1. The spring 18 is constituted of a tension spring and always applies the biasing force in the direction indicated by the arrow C to the load lever 14. The spring 18 biases the load lever 14 in the direction indicated by the arrow C even when the rotational driving force from the electric motor 4 to the cam lever 11 is released, so that the cam lever 11 is compulsorily rotated to cause the roller 17 attached to the adjustment member 44 to make its relative displacement toward the bent section 12C of the elongate opening 12. By this, the cam lever 11 stops in rotational movement at a position where the roller 17 comes into contact with the bent section 12C of the elongate opening 12 as shown in FIG. 19. At this time, the throttle valve 3 is kept in the intermediately opened or partly opened position shown in FIG. 22. In other words, when the cam lever 11 is rotated in the direction indicated by the arrow A from the position shown in FIG. 19, the roller 17 of the load lever 14 is brought into contact with the periphery of the short opening section 12B of the elongate opening 12 as shown in FIG. 20, so that the throttle valve 3 is rotated to the closed position shown in FIG. 23. When the cam lever 11 is rotated in the direction indicated by the arrow B from the position shown in FIG. 19, the roller 17 of the load lever 14 is brought into contact with the periphery of the long opening section 12A of the elongate opening 12 as shown in FIG. 21, so that the throttle valve 3 is rotated to the fully opened position shown in FIG. 24.

The stopper 20 is provided to restrict the closed position of the throttle valve 3, and includes the stopper projection 21 which is located inside the gear casing 1C and formed integral with the throttle body 1 as shown in FIGS. 18 and 19. The eye bolt 22 is screwed in the stopper projection 21. The nut 23 is threadedly mounted on the eye bolt 22. The tip end section of the eye bolt 22 is contactable with the bent claw section 11B of the cam lever 11 as shown in FIG. 20, thereby preventing the throttle valve 3 from moving from the position indicated by the solid lines in FIG. 23 in the direction (indicated by the arrow A) to further close the throttle valve. Here, in this stopper 20, the projection amount of the eye bolt 22 in the direction toward the bent claw section 11B of the cam lever 11 can be suitably adjusted by changing the screwing position of the eye bolt 22 relative to the stopper projection 21 under a condition where the nut 23 is loosened. Thus, the closing position of the throttle valve 3 is variably adjusted in accordance with the projection amount of the eye bolt 22, for example, between the closed position indicated by the solid lines and the fully closed position indicated in phantom in FIG. 23.

Figure 23:
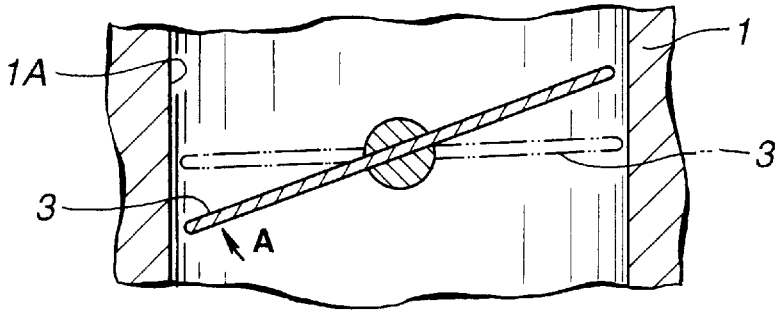
FIG. 23 is an enlarged sectional view similar to FIG. 22 but showing another state where the throttle valve is at the closing position.

It will be understood that the closed position indicated by the solid lines in FIG. 23 is obtained by changing the closed position of the throttle valve 3 by a certain angle relative to the fully closed position indicated in phantom in order to allow air in an amount corresponding to an idling speed of the engine to flow to the side of combustion chambers of the engine. Additionally, the nut 23 forming part of the stopper 20 is again threadedly mounted on the eye bolt 22 after adjustment of the projection amount of the eye bolt 22 thereby preventing the eye bolt 22 from being loosened.

The gear cover 24 is detachably installed to the gear casing 1C of the throttle body 1 to cover the reduction gear mechanism 5 and the like inside the gear casing 10 as shown in FIG. 18, thereby preventing rain water and the like from penetrating into the gear casing 1C. It will be understood that the throttle valve device D in FIGS. 19 to 21 is shown in a state where the gear cover 24 is removed from the gear casing 1C for the purpose of clearly disclosing the reduction gear mechanism 5 and the like. The accelerator operation amount detecting device 25 is disposed to the throttle body 1 and includes the wire drum 26 as shown in FIG. 18. The one end section of the wire 28 is fixed to and wound on the wire drum 26, while the other end section of the wire 28 is connected to the accelerator pedal (not shown) of the vehicle. The wire drum 26 is biased by the return spring 27. When a driver of the vehicle depressed or operates the accelerator pedal, the wire drum 26 is rotated against the bias of the return spring 27 by an amount corresponding to the accelerator operation amount (the operation amount of the accelerator pedal). The accelerator operation amount is detected by the operation amount sensor 30. The wire guide 29 is attached to the accelerator operation amount detecting device 25 to smoothly guide the wire 28 which is unwound from or wound on the wire drum 26.

The operation amount sensor 30 is constituted of a potentiometer and the like, and adapted to detect the rotational amount of the wire drum 26 as the accelerator operation amount so as to generate a detection signal representative of the accelerator operation amount. The detection signal is output to the control unit (not shown) for engine control. The control unit generate a driving signal corresponding to the accelerator operation amount in accordance with the detection signal and output the driving signal to the electric motor 4, thereby controllably rotating the electric motor 4. As a result, the throttle valve 3 is rotated by an amount corresponding to the accelerator operation amount through the reduction gear mechanism 5. The throttle sensor 31 is disposed in the sensor casing 1D and constituted of a potentiometer and the like similarly to the operation amount sensor 30. The throttle sensor 31 is adapted to detect a rotational angle of the valve shaft 2 as an opening angle or throttle valve position which is referred hereinafter to as the "throttle opening degree".

The manner of operation of the second embodiment throttle valve device D will be discussed hereinafter.

Figure 22:
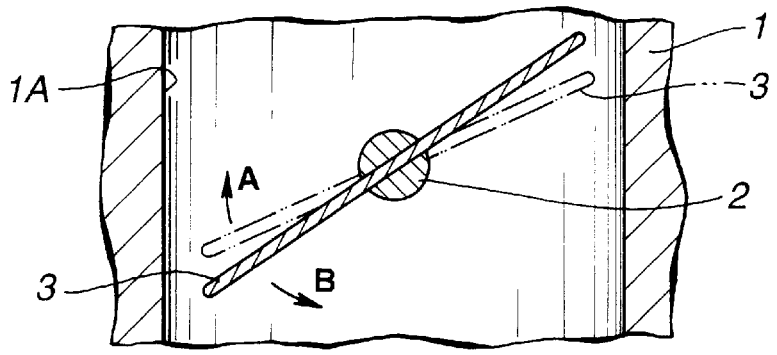
FIG. 22 is an enlarged sectional view showing a state where the throttle valve is at its intermediately or partly opened position.
Figure 24:
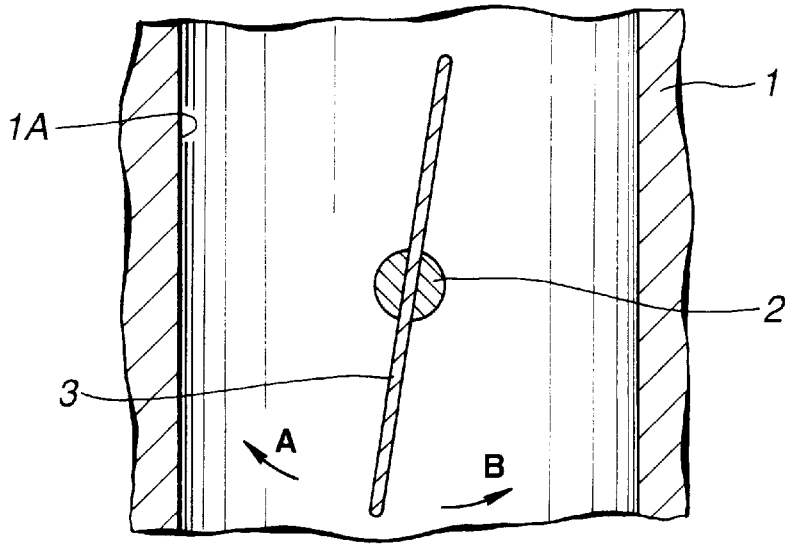
FIG. 24 is an enlarged sectional view similar to FIG. 22 but showing a further state where the throttle valve is at the fully opened position.

First, when the driver of the vehicle depresses the accelerator pedal to make an accelerator operation, an operation or depression force applied to the accelerator pedal is transmitted through the wire 28 to the wire drum 26 of the accelerator operation amount detecting device 25 so that the wire drum 26 is rotated by an angle corresponding to the accelerator operation amount against the bias of the return spring 27. When the operation amount sensor 30 detects the rotation (corresponding to the accelerator operation amount) of the wire drum 26, the detection signal from the operation amount sensor 30 is output to the control unit for engine control. Then, the control unit generates the driving signal corresponding to the accelerator operation amount in accordance with the detection signal, and outputs the driving signal to the electric motor 4. As a result, the electric motor 4 is rotatably driven in one direction. The rotational speed of the electric motor 4 is reduced by the reduction gear mechanism 5 so that a larger torque is transmitted to the valve shaft 2. Accordingly, the throttle valve 3 is rotated together with the valve shaft 2 as a one-piece member as shown in FIGS. 22 to 24, in which the opening degree of the throttle valve 3 is controlled corresponding to the accelerator operation amount.

Additionally, the cam lever 11 fixed together with the driven gear 8 on the valve shaft 2 is rotatable together with the valve shaft 2 as a one-piece member. At the fully opened position of the throttle valve 3 as shown in FIG. 24, the cam lever 11 is also rotated in the direction indicated by the arrow B, so that the load lever 14 is rotated in the opposite direction to that indicated by the arrow C, together with the roller 17 on the adjustment member 44, along the long opening section 12A of the elongate opening 12 whose periphery constitutes the cam face as shown in FIG. 21. This increases the biasing force of the spring 18. At the closed position of the throttle valve 3 as shown in FIG. 23, the cam lever 11 is rotated together with the valve shaft 2 in the direction indicated by the arrow A, so that the load lever 14 is also rotated together with the roller 17 in the opposite direction to that indicated by the arrow C along the short opening section 12B of the elongate opening 12 as shown in FIG. 20.

When a rotational driving force to the reduction gear mechanism 5 is released by interrupting power supply to the electric motor 4 at stoppage or the like of the engine, a rotational force in the direction indicated by the arrow C is applied to the load lever 14 and around the fixed pin 13. Then, the load lever 14 causes the cam lever 11 to make its relative rotation in such a manner that the roller 17 is guided to the bent section 12C of the cam surface of the elongate opening 12. By this, the cam lever 11 makes its stop in rotation at a position where the roller 17 comes into contact with the bent section 12C of the cam surface of the elongate opening 12 as shown in FIG. 19. At this time, the throttle valve 3 is kept in the intermediately (partially) opened position shown in FIG. 22.

In other words, the cam lever 11 is fixedly mounted through its fitting hole 1A (through which the rotational center axis O passes) on the valve shaft 2 in such a manner to be prevented from movement relative to the valve shaft 2. As shown in FIG. 27, the long opening section 12A and the short opening section 12B of the elongate opening 12 are formed to have such a shape that the radial distance of the outer periphery P1 of the long opening section 12A takes the maximum value L1 at the end portion close to the bent section 12C, in which the same radial distance gradually decreases toward the other end portion 12D. As a result, when the rotational force of the electric motor 4 is released, the cam lever 11 is automatically rotated into the position as shown in FIG. 19 under the bias of the spring 18 applied through the load lever 14, thereby automatically returning the throttle valve 3 in its intermediately opened position as shown in FIG. 22.

Figure 25:
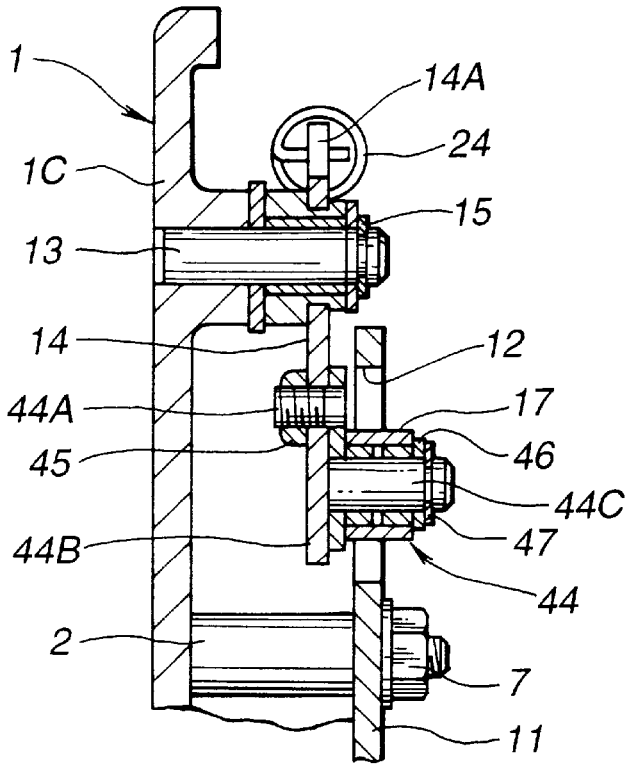
FIG. 25 is an enlarged sectional view taken in the direction of arrows substantially along the line 25—25 of FIG. 19.

In order to adjust the intermediately opened position of the throttle valve 3, the nut 45 on the adjustment member 16 shown in FIGS. 25 and 26 is loosened, and then the adjustment plate 44B is rotated in the direction indicated by the arrow D or E in FIG. 26 around the installation screw section 44A. For example, when the adjustment plate 44B is rotated in the direction indicated by the arrow D from a state shown in FIG. 29 to a state shown in FIG. 30 to change the installation position of the roller 17 relative to the load lever 14, the rotational position of the cam lever 11 in a state where the roller 17 is in engagement with the bent section 12C of the elongate opening 12 is changed. This changes the intermediately opened position of the throttle valve 3 from the position indicated by solid lines to the position indicated in phantom in FIG. 22. In other words, when the installation position of the roller 17 relative to the load lever 14 is adjusted at the position shown in FIG. 29, the throttle valve 3 takes the intermediately opened position indicated by solid lines in FIG. 22. When the installation position of the roller 17 is changed into the position shown in FIG. 30, the throttle valve 3 takes the intermediately opened position indicated in phantom in FIG. 22. Thus, fine adjustment for the valve opening degree or throttle opening degree of the throttle valve 3 can be readily accomplished.

According to this embodiment, the motor storing casing 1B is formed within the throttle body 1 and separate from the throttle chamber 1A, in which the electric motor 4 is disposed inside the motor storing casing 1B. Additionally, the output shaft 4A of the electric motor 4 is projected into the gear casing 1C formed at one side of the throttle body 1, while the reduction gear mechanism 5 is disposed between the output shaft 4A and the valve shaft 2 for the throttle valve 3. With this configuration, the rotational speed of the electric motor 4 is reduced by the reduction gear mechanism 5 so as to generate a larger rotational torque at the valve shaft 2. As a result, the throttle valve 3 can be securely operated to open or close through the valve shaft 2 even in case that the electric motor 4 is small-sized and low in output torque. Accordingly, it is made possible to use a small-sized motor as the electric motor 4 thereby achieving energy saving and a smooth control for intake air amount in accordance with the opening degree of the throttle valve 3.

In this embodiment, the reduction gear mechanism 5 is disposed inside the gear casing 10 of the throttle body 1 and is constituted of the drive gear 6, the driven gear 8 and the intermediate gear 9. The drive gear 6 is fixedly mounted on the output shaft 4A of the electric motor 4. The driven gear 8 is fixedly mounted on the valve shaft 2. The intermediate gear 9 includes the large-diameter gear 9A engaged with the drive gear 6, and the small-diameter gear 9B engaged with the driven gear 8. With this configuration, the speed reduction ratio of the reduction gear mechanism 5 can become high or large, while the reduction gear mechanism 5 can be compactly encased inside the gear casing 1C thereby making the whole throttle valve device D small-sized and light in weight.

Furthermore, within the gear casing 1C, the load lever 14 is rotatably disposed through the fixed pin 13 and the like and located generally radially separate from the cam lever 11 incorporated with the driven gear section 43. Additionally, the load lever 14 is provided with the adjustment member 44 in a manner to be adjustable in its location, so that the roller 17 on the adjustment member 44 is rotatably inserted inside the elongate opening 12. Additionally, the load lever 14 is provided with the single spring 18 for always biasing the roller 17 to the periphery of the elongate opening 12 so that the load lever 14 is biased toward the bent section 12C of the cam surface of the elongate opening 12 under the action of the spring 18 when the driving force of the electric motor 4 is released. By this, the rotational driving force from the electric motor 4 is transmitted through the reduction gear mechanism 5 to the valve shaft 2 and the cam lever 11, in which the cam lever 11 is rotated between the closed position and the fully closed position of the throttle valve 3. Additionally, the load lever 14 can be rotated upon being guided along the elongate opening 12 against the bias of the spring 18, thereby continuously applying the biasing force of the spring 18 to the cam lever 11 as a reaction during rotation.

Furthermore, when the driving force of the electric motor is lost owing to stoppage of the engine (interruption of power supply to the electric motor 4) or trouble or the like of the electric motor 4, the single spring 18 biases the roller 17 of the load lever 14 toward the bent section 12C of the cam lever 11, so that the cam lever 11 can be compulsorily rotated through the roller 17 or through the load lever 14. As a result, the rotational movement of the cam lever 11 can be stopped at the position where the roller 17 of the load lever 14 is brought into contact with the bent section 12C of the cam surface of the cam lever 11, while the throttle valve 3 can be automatically returned to the intermediately (partly) opened position as shown in FIG. 22 under such a condition.

As a result, even in case that the vehicle is left as it is upon the engine being stopped in a cold district, the throttle valve 3 can be kept in the intermediately opened position, and therefore the throttle valve 3 is prevented from becoming immovable under freezing thereby improving engine starting ability at low temperatures, engine reliability and the like. Additionally, even in case that the electric motor 4 is in trouble, the throttle valve 3 can be kept in the intermediately opened position, and therefore it is possible to continuously supply the minimum amount of intake air to the engine so that the vehicle can continuously run at a low speed, for example, toward an auto repair shop.

Besides, when the installation position of the adjustment member 44 for the intermediately opened position of the throttle valve 3 under the action of the installation screw section 44A and the nut 45, the rotational position of the cam lever 11 is changed in a state where the roller 17 is in engagement with the bent section 12C of the cam surface of the elongate opening 12. This changes the intermediately opened position of the throttle valve 3 to the position indicated by solid lines or the position indicated in phantom in FIG. 22, thereby accomplishing fine adjustment of the valve opening degree of the throttle valve 3 at the intermediately opened position. Accordingly, with this embodiment of the present invention, the throttle valve 3 can be continuously kept at the intermediately opened position by using only the single spring 18 in case of power supply stop, trouble or the like of the electric motor 4. This can reduce the number of parts of the throttle valve device D thereby improving the operational efficiency during assembly of the throttle valve device D, and makes the whole throttle valve device 3 small-sized and formed compact, while stabilizing an opening adjustment of the throttle valve 3.

Since the cam lever 11 is configured to be detachably mounted on the one end section of the valve shaft 2 of the cam lever 11, the opening degree of the throttle valve 3 at the intermediately opened position can be easily altered merely by changing the cam lever 11 upon preparing a plurality of cam levers (11) which are different in shape of the cam surface defined by the elongate opening 12. This can readily deal with change in engine specification, vehicle kind or the like which requires change in opening degree of the throttle valve 3 at the intermediately opened position.

Further, the elongate opening 12 of the cam lever 11 is provided with a function as a stopper for determining the maximum and minimum opening degrees of the throttle valve 3 by means of the elongate opening 12 of the cam lever 11, so that no special stopper or the like is necessary to be provided. Besides, by bringing the bent claw section 11B of the cam lever 11 into contact with the eye bolt 22 of the stopper 20 at the closed position of the throttle valve 3, the opening degree of the throttle valve 3 at the closed position can be variably changed thereby making it possible to adjust the idling engine speed of the engine by changing the amount of projection of the eye bolt 22 from the stopper projection 21.

FIGS. 31 to 36 illustrate a fourth embodiment of the throttle valve device D according to the present invention, which is similar to the third embodiment of FIGS. 18 to 30 with the exception that the driven gear 8 is independent from the cam lever 11 and is provided in place of the driven gear section 43 of the third embodiment.

Figure 32:
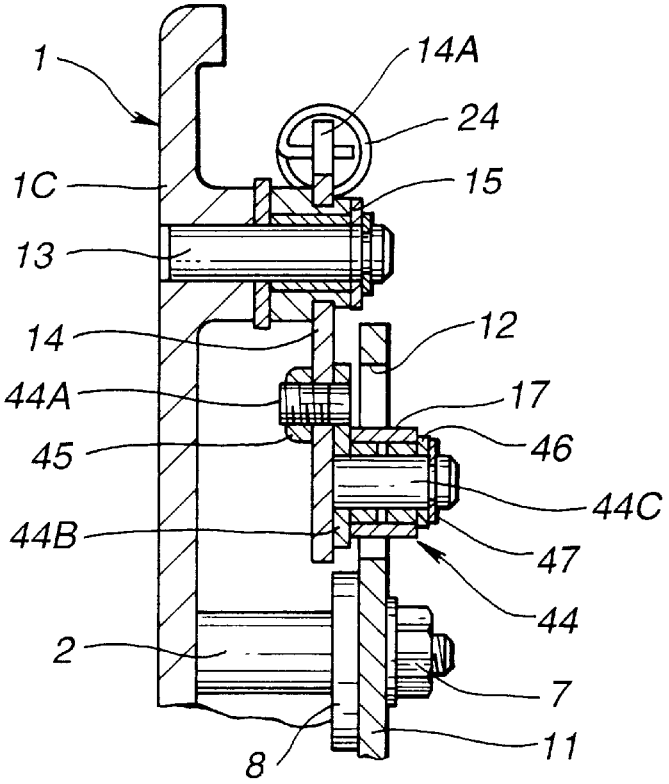
FIG. 32 is a sectional view taken in the direction substantially along the line 32—32 of FIG. 31.
Figure 33:
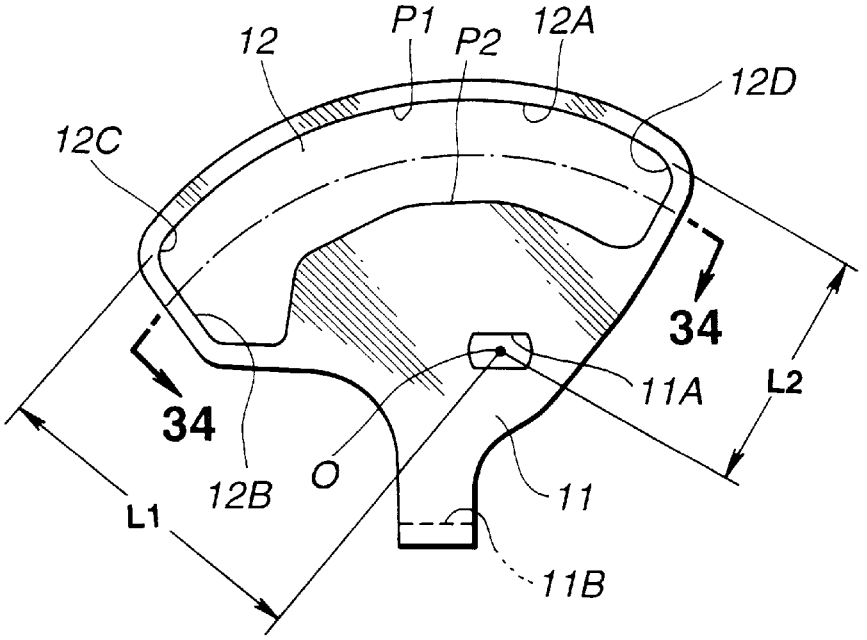
FIG. 33 is an enlarged front view showing a cam lever used in the throttle valve device of FIG. 31.
Figure 34:
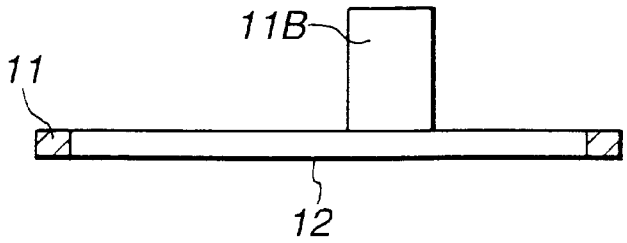
FIG. 34 is a sectional view taken in the direction substantially along the line 34—34 of FIG. 33.
Figure 35:
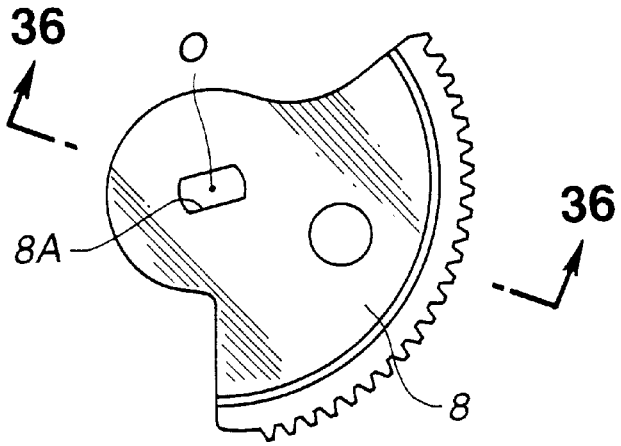
FIG. 35 is an enlarged front view of a driven gear used in the throttle valve device of FIG. 31.
Figure 36:
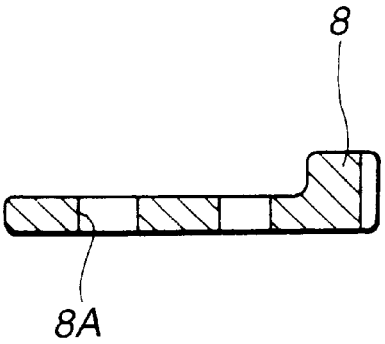
FIG. 36 is a sectional view taken in the direction substantially along the line 36—36 of FIG. 35.

More specifically, the driven gear 8 is generally sectoral in plan and serves as a sector gear whose diametrical dimension is larger than the diameter of the small-diameter gear section 9B of the intermediate gear 9. The non-circular fitting hole 8A is formed at the section (of the driven gear 8) through which the rotational center axis O passes, as shown in FIGS. 35 and 36. The driven gear 8 is fitted on the one end section of the valve shaft 2 in such a manner as to be prevented from rotating relative to the valve shaft 2. Additionally, the driven gear 8 is tightened on the valve shaft 2 by the nut 7 as shown in FIG. 32, so that the driven gear 8 can rotate together with the valve shaft 2 like a one-piece member.

It will be appreciated that the thus arranged fourth embodiment throttle valve device D can provide the same effects as those in the third embodiments.

While the adjustment member 44 attached to the load lever 14 has been shown and described as including the installation screw section 44A, the adjustment plate 44B and the support shaft section 44C and being arranged such that the installation position of the roller 17 relative to the load lever 14 is changed by rotationally moving the adjustment plate 44B around the installation screw section 44A in the third and fourth embodiments, it will be understood that a plurality of insertion holes (not shown) may be formed in the load lever 14 in a manner to be aligned in the longitudinal direction of the load lever 14, in which the installation screw section 44A is selectively inserted into each of the insertion holes, followed by tightening the nut 45. It will be understood that the intermediately opened position of the throttle valve 3 can be adjustable also in this case.

Although the installation screw section 44A of the adjustment member 44 has been shown and described as being fixed in a manner not to be rotated relative to the load lever 14 under the action of the nut 45, it will be appreciated that in order to accomplish a further secure rotation-prevention, the insertion hole 14B of the load lever 14 may be formed with an internal spline while the installation screw section 44A may be formed at the outer peripheral surface of its base end section with an external spline. With this configuration, when the installation position of the roller 17 relative to the load lever 14 is changed, the adjustment plate 44B is rotated around the installation screw section 44A, and then the installation screw section 44A is spline-connected at its suitable rotational position in the insertion hole 14B of the load lever 14, followed by tightening the nut 45.

While the above embodiments have been shown and described such that the spring 18 as the biasing device is constituted of the tension spring disposed between the holding section 14A of the load lever 14 and the catching projection 19 of the throttle body 1, it will be understood that the spring 18 may be a helical spring or the like to provide a rotational force in the direction indicated by the arrow C to the load lever. Otherwise, the spring may be a compression spring.

Although the valve shaft 2 of the throttle valve 3 has been shown and described as being rotated by the electric motor 4 in the above embodiments, it will be appreciated that the valve shaft 2 of the throttle valve 3 may receive a rotational force from a driving device such as a hydraulic actuator or the like, through the reduction gear mechanism 5.

While the operational force of the accelerator pedal has been shown and described as being transmitted through the control unit in the above embodiments, the electric motor 4 and the like to the drive gear 6, it will be understood that the operational force of the accelerator pedal may be transmitted to the drive gear 6 through a mechanical device including a wire. In this case, when a depression force against the accelerator pedal is released or even when the wire is broken, the throttle valve 3 can be kept at the intermediately opened position.

Although the cam lever 11 has been shown and described as being disposed together with the drive gear 8 or the drive gear section 43 in the above embodiments, it will be appreciated that the cam lever 11 may be disposed, for example, together with the intermediate gear or the like of the reduction gear mechanism.

What is claimed is:

1. A throttle valve device comprising:

a throttle body having a part of an intake air passageway;

a throttle valve fixedly mounted on a valve shaft and rotatably disposed in the part of said intake air passageway;

a driving device disposed to said throttle body to drive said throttle valve through said valve shaft;

a reduction gear mechanism through which said driving device and said valve shaft are mechanically connected so as to transmit a driving force of said driving device to said valve shaft in a manner to accomplish a speed-reduction for a rotational movement of said driving device to be transmitted to said valve shaft;

a cam lever incorporated with said reduction gear mechanism and having a cam surface which is configured to allow said throttle valve to rotate from a fully closed position to a fully opened position, said cam surface having a bent section which causes said throttle valve to take a partly opened position located between said fully closed and opened positions;

a cam follower rotatably disposed to said throttle body and in contact with said cam surface of said cam lever;

a biasing device for always biasing said cam follower onto said cam surface of said cam lever, said biasing device being able to force said cam follower onto said bent section of said cam surface so as to keep said throttle valve at the partly opened position when the driving force of said driving device is released.

2. A throttle valve device as claimed in claim 1, wherein said reduction gear mechanism includes a drive gear drivably connected to said driving device, and a driven gear drivably connected to said drive gear and fixedly mounted on an end section of said valve shaft to transmit a rotational movement of said drive gear to said valve shaft, said driven gear being fixed together with said cam lever as a one-piece member to said valve shaft.

3. A throttle valve device as claimed in claim 2, wherein said cam lever has a fitting hole in which the end section of said valve shaft is inserted in a manner to be prevented from rotation, and an elongate opening whose periphery serves as said cam surface which is formed endless, said endless cam surface having said bent section of a generally V-shaped in section, said elongate opening being located generally radially separate from said fitting hole.

4. A throttle valve device as claimed in claim 3, wherein said elongate opening includes a generally arcuate long opening section which is located generally radially separate from said fitting hole and generally peripherally extends, a short opening section which is connected with said long opening section and generally radially extends, said bent section being located at a first end portion of said short opening, a second end portion of said short opening section being located closer to said fitting hole than said first end portion.

5. A throttle valve device as claimed in claim 3, wherein said cam lever and said driven gear are formed independent from each other, said driven gear having a fitting hole in which the end section of said valve shaft is inserted in a manner to be prevented from rotation.

6. A throttle valve device as claimed in claim 3, wherein said driven gear is fixedly secured to said cam lever, said driven gear being located generally peripherally separate from said elongate opening.

7. A throttle valve device as claimed in claim 1, wherein said driving device includes an electric motor disposed in said throttle body, wherein said reduction gear mechanism includes a drive gear fixedly mounted on an output shaft of said electric motor, a driven gear fixedly mounted on an end section of said valve shaft, and an intermediate gear interposed between said drive gear and said driven gear to transmit a rotational movement of said drive gear to said driven gear.

8. A throttle valve device as claimed in claim 1, wherein said cam follower includes a rotatable member which is in contact with said cam surface of said of said cam lever, wherein said throttle valve device further comprises an adjustment member for adjusting the partly opened position of said throttle valve, said adjustment member being locationally adjustably installed to a main section of said rotatable member, said rotatable member being rotatably mounted on said adjustment member.

9. A throttle valve device as claimed in claim 8, wherein said adjustment member is generally crank-shaped and first and second end sections which are opposite to each other, said first end section of said adjustment member being rotatably inserted into the main body of said cam follower, said rotatable member being rotatably mounted on said second end section of said adjustment member.

10. A throttle valve device as claimed in claim 1, wherein said cam follower includes a main body, and a roller which is rotatably attached to the main body and in contact with said cam surface of said cam lever, wherein said throttle valve device comprises an adjustment member for adjusting the partly opened position of said throttle valve, locationally adjustably disposed to the main body of said cam follower, said adjustment member including an adjustment plate, a first elongate section which is rotatably connected to the main body of said cam follower, and a second elongate section fixed to said adjustment plate, said first and second elongate sections being parallel with each other and separate from each other, said roller of said cam follower being rotatably mounted on the second elongate section.

11. A throttle valve device comprising:

a throttle body having a part of an intake air passageway;

a throttle valve fixedly mounted on a valve shaft and rotatably disposed in the part of said intake air passageway;

a driving device disposed to said throttle body to drive said throttle valve through said valve shaft;

a reduction gear mechanism through which said driving device and said valve shaft are mechanically connected so as to transmit a driving force of said driving device to said valve shaft in a manner to accomplish a speed-reduction for a rotational movement of said driving device to be transmitted to said valve shaft;

a cam follower rotatably disposed to said throttle body;

a single biasing device for always biasing said cam follower onto said cam surface of said cam lever; and a cam lever incorporated with a gear of said reduction gear mechanism to rotate together with said gear as a one-piece member, said cam lever having an opening whose periphery serves as a cam surface on which said cam follower is in press contact under a biasing force of said biasing device, said cam surface being configured to allow said throttle valve to rotate from a fully closed position to a fully opened position, said cam surface having a bent section which causes said throttle valve to take a partly opened position when the driving force of said driving device is released, said partly opened position being between said fully closed and fully opened positions.

* * * * *